US011076455B2

(12) United States Patent
Kelly et al.

(10) Patent No.: US 11,076,455 B2
(45) Date of Patent: Jul. 27, 2021

(54) INDUCTION HEATING TOOL FOR MEMBRANE ROOFING

(71) Applicant: OMG, Inc., Agawam, MA (US)

(72) Inventors: Joshua S. Kelly, Longmeadow, MA (US); Tamilselvan Samiappan, Simsbury, CT (US); David R. Pacholok, Sleepy Hollow, IL (US); William F. Mast

(73) Assignee: OMG, Inc., Agawam, MA (US)

( * ) Notice: Subject to any disclaimer, the term of this patent is extended or adjusted under 35 U.S.C. 154(b) by 265 days.

(21) Appl. No.: 15/958,417

(22) Filed: Apr. 20, 2018

(65) Prior Publication Data

US 2018/0242408 A1 Aug. 23, 2018

Related U.S. Application Data

(63) Continuation-in-part of application No. 14/552,952, filed on Nov. 25, 2014, now Pat. No. 10,925,124.
(Continued)

(51) Int. Cl.
*H05B 6/14* (2006.01)
*H05B 6/06* (2006.01)
(Continued)

(52) U.S. Cl.
CPC ..... *H05B 6/14* (2013.01); *E04D 15/04* (2013.01); *H05B 6/06* (2013.01); *H05B 6/101* (2013.01);
(Continued)

(58) Field of Classification Search
None
See application file for complete search history.

(56) References Cited

U.S. PATENT DOCUMENTS 3,109,084 A 10/1963 Walsh
4,151,387 A 4/1979 Peters, Jr.
(Continued)

FOREIGN PATENT DOCUMENTS

WO 0133909 A2 5/2001
WO 2006104740 A1 10/2006

OTHER PUBLICATIONS

"The SFS intec field fastening system isoweld," product brochure, SFS intec, Inc., Fastening Systems, Wyomissing, PA, 2013.
(Continued)

*Primary Examiner* — Tu B Hoang
*Assistant Examiner* — Masahiko Muranami
(74) *Attorney, Agent, or Firm* — Alix, Yale & Ristas, LLP

(57) ABSTRACT

A portable induction heating tool includes a housing which includes a base having a support surface. The support surface defines a recess facing away from the housing. The recess is at least partially defined by a wall projecting from the support surface. A work coil is within the housing and secured to the base in a location aligned with the recess. The portable induction heating tool includes electronic circuitry which is configured to provide oscillating electrical energy to the work coil, thereby generating an oscillating magnetic field projecting away from the base. The electronic circuitry is also configured to detect a quantity of energy consumed by the work coil and to limit the quantity of energy to a predetermined quantity.

7 Claims, 20 Drawing Sheets

Related U.S. Application Data

(60) Provisional application No. 62/487,887, filed on Apr. 20, 2017.

(51) Int. Cl.
*H05B 6/10* (2006.01)
*H05B 6/42* (2006.01)
*E04D 15/04* (2006.01)

(52) U.S. Cl.
CPC ..... *H05B 6/105* (2013.01); *H05B 6/42* (2013.01); *E04D 2015/042* (2013.01)

(56) References Cited

U.S. PATENT DOCUMENTS 4,686,340 A * 8/1987 Fukasawa ..... H05B 6/062 219/664
5,919,387 A 7/1999 Buckley et al.
6,229,127 B1 * 5/2001 Link ..... H05B 6/06 219/635
7,491,916 B1 2/2009 Barber et al.
8,492,683 B2 7/2013 Challita et al.
8,933,379 B2 1/2015 Challita et al.
2002/0020144 A1 * 2/2002 Sarles ..... B29C 66/53421 53/329
2003/0071033 A1 * 4/2003 Riess ..... B23K 13/01 219/633
2003/0075540 A1 4/2003 Riess et al.
2005/0199615 A1 * 9/2005 Barber ..... B23K 3/04 219/672
2007/0023422 A1 2/2007 Obata et al.
2008/0029507 A1 * 2/2008 Barber ..... E04D 15/04 219/633
2009/0321423 A1 12/2009 Challita et al.
2012/0285946 A1 * 11/2012 Brosnan ..... H05B 6/062 219/621
2013/0119049 A1 5/2013 Graber et al.
2013/0218152 A1 * 8/2013 Manwaring ..... A61B 17/3211 606/31
2015/0144617 A1 5/2015 Challita et al.
2016/0073452 A1 * 3/2016 Fanetti ..... B23K 26/60 219/601

OTHER PUBLICATIONS

International Search Report and Written Opinion dated Jul. 5, 2018 for PCT/US2018/028494.
Extended European Search Report for Application No. 18788174.3-1202/3613259; PCT/US2018/028494 dated Nov. 27, 2020; 7 pgs.

* cited by examiner

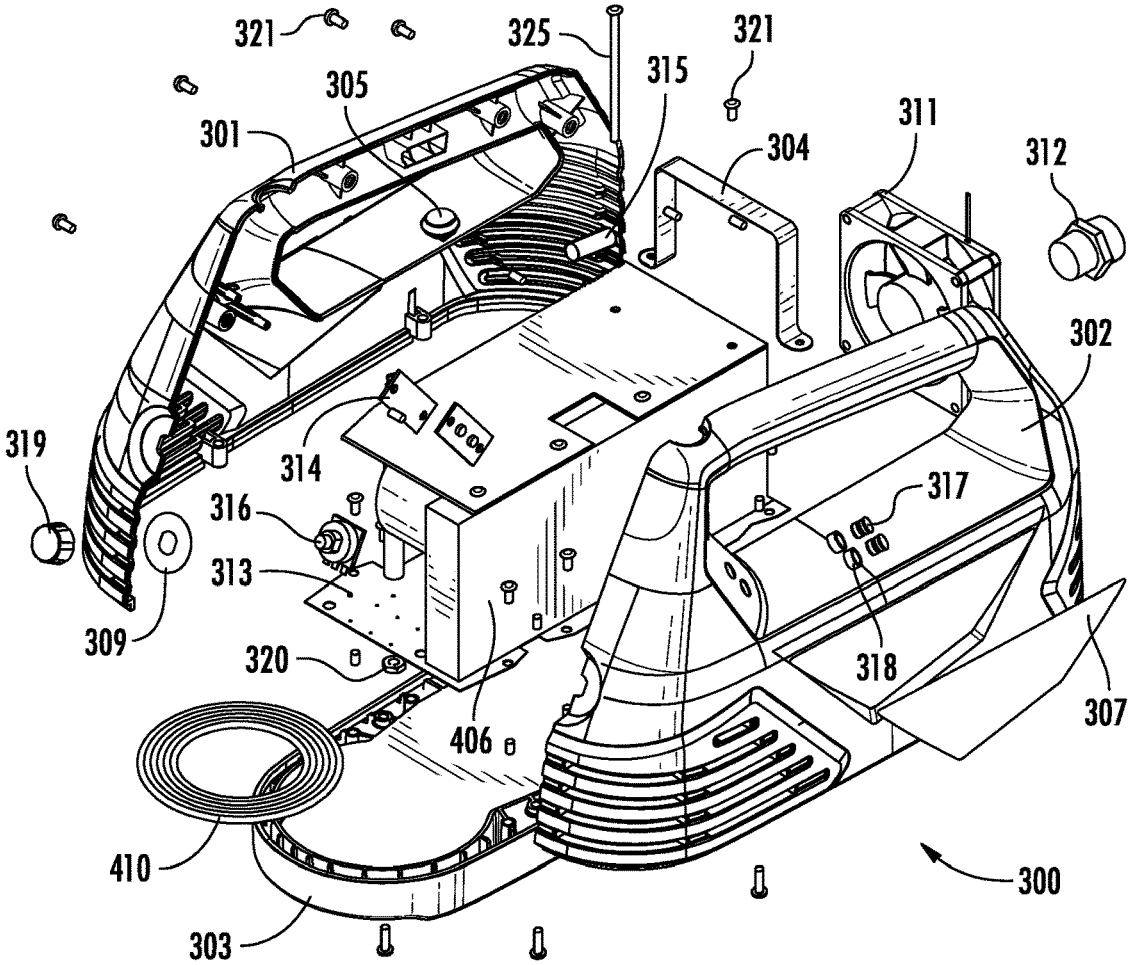

| DESCRIPTION | MATERIAL | REFERENCE NO. |
|---|---|---|
| MAIN HOUSING- RIGHT | ABS | 301 |
| MAIN HOUSING- LEFT | ABS | 302 |
| BASE OF MAIN BODY | ULTEM 1010 | 303 |
| FAN ASSY HOLD DOWN STRAP | SHEET METAL | 304 |
| TOP ACTIVATION SWITCH | NA | 305 |
| MAIN HOUSING LABEL- LEFT | POLYESTER | 307 |
| TEMPERATURE INDICATOR | POLYESTER | 309 |
| HEAT SINK | | 406 |
| CIRCULATION FAN | NA | 311 |
| MILL SPEC POWER CONNECTOR .88 | NA | 312 |
| PCB_ELECTRONICS ASSEMBLY | NA | 313 |
| LED ELECTRONIC BOARD | | 314 |
| ACTIVATION VIBRATION MOTOR | NA | 315 |
| TEMPERATURE POTENTIOMETER | NA | 316 |
| LED OPTIC LENS_VCC | | 317 |
| OPTIC LENS LOCK RING_VCC | | 318 |
| TEMPERATURE KNOB | BRASS | 319 |
| #6/32 - NUT | STAINLESS STEEL | 320 |
| #6-32 - SCREW - 0.25" | STAINLESS STEEL | 321 |
| #632 - SCREW - 4.00" | STAINLESS STEEL | 325 |
| WORK COIL - LITZ | 1 50X#36 LITX, SINGLE LAYER | 410 |

FIG. 15

INDUCTION HEATING TOOL FOR MEMBRANE ROOFING

BACKGROUND

The present disclosure relates to tools for inductively heating metal objects and specifically relates to tools for inductively heating adhesive-coated plates that secure a roofing membrane to a roof structure.

Portable induction heating tools which are employed to seal roofing anchor plates having a heat-activated adhesive to an overlying roofing membrane are well known. It is particularly advantageous that the induction heating tool be of a type which can be placed over an anchor plate to be sealed and activated for heating the underlying metal anchor plate to activate the adhesive while the operator remains in a standing position during tool operation. Because the anchor plates are typically disposed below a membrane and are hidden, it can be challenging to clearly identify the position of the anchor plate and to properly position the tool over the anchor plate. The anchor plate may produce a slightly raised area or protuberance beneath the membrane, which may serve as a guide for positioning of the tool.

Some roofing installations include a thin sheet of metal foil on one face of the rigid foam insulation typically arranged beneath the membrane. To reliably heat the anchor plates, it is necessary to accurately couple the powerful magnetic field generated by the induction heating tool to the anchor plate while minimizing the magnetic energy dispersed into the surrounding foil. Therefore, it is important that the induction heating tool generate a magnetic field closely matched to the shape of the anchor plate and to align the induction coil over the anchor plate during each induction heating cycle. Accordingly, it is highly desirable to provide an induction heating tool that can be operated to accurately and consistently heat the metal anchor plate without losing energy to the surrounding foil.

A common configuration for an induction bonding tool allows the user to stand upright while inductively heating each bonding plate. This saves the operator from kneeling or getting up and down from a bent-over position. Most locations on a membrane roof are unobstructed, making use of a so-called "stand-up" inductive heating tool. However, some locations on a membrane roof project may be cramped and relatively inaccessible, making the use of a large bulky tool impossible. Examples include areas on the upright portion of a parapet wall at the edge of a roof, or areas around and beneath roof mounted equipment such as HVAC systems.

SUMMARY OF THE INVENTION

An induction heating tool has an induction heating coil configured to generate a magnetic field closely matched to the shape of the anchor plate. The induction heating tool includes a base configured to assist an operator in aligning the coil over each anchor plate. In some the disclosed embodiments, a stand up induction heating tool includes a base supporting a circular induction coil, where the base has a structure that clearly shows the position of the induction coil. In the disclosed embodiments of a stand up induction heating tool, material of the base surrounding the induction coil is removed or made transparent so the operator can see the roof immediately surrounding the induction coil as an additional aid in positioning the tool over anchor plates.

One embodiment of an induction heating tool is intended for use in locations where a stand up tool is impractical. A hand-held induction bonding tool is a compact, self-contained and ergonomic tool for inductively heating adhesive coated bonding plates in a membrane roofing system. The tool may include a temperature sensor configured to detect the ambient temperature of the roofing membrane and bonding plate. The ambient temperature is provided to the electrical circuit generating the high frequency magnetic field that inductively heats the bonding plate. The ambient temperature serves to increase (when the roof is cold) or decrease (when the roof is hot) the amount of energy delivered to the plate. The temperature sensor is secured to the base of the hand-held tool, close to the membrane when the tool is in use. The temperature sensor is continuously connected to the drive circuit and provides an input that varies with the temperature of the roofing membrane.

The disclosed hand-held induction bonding tool may also include a manual adjustment for increasing or decreasing energy delivered by the tool. The manual adjustment is in the form of a rotary knob having a center position representing a neutral energy adjustment, where the energy delivered to the plate is determined by the drive circuit. Rotating the knob counter clockwise reduces the energy generated by the drive circuit, while rotating the knob clockwise increases the energy generated by the drive circuit. The manual adjustment reduces or increases the energy delivered by a predetermined amount, for example the predetermined amount is about +/−20%, or about +/−15%. This adjustment can be used to compensate for conditions present in a particular project, such as moisture present between the membrane and the bonding plate, e.g., beneath the membrane.

The disclosed hand-held induction bonding tool may include visual and/or vibratory feedback to the operator. The visual feedback may take the form of colored LEDs visible to the operator of the hand-held tool. One form of LED visual feedback may take the form of green and red lights visible from either side of the tool (for left or right hand operation). Green lights indicate the tool is powered on and ready to initiate a bonding cycle, while red lights indicate a bonding cycle has been initiated. The LED lights are selected to be of high brightness, for visibility in full daylight and are provided with lenses that spread the light, making the light visible from a range of angles.

The vibratory feedback may be provided by a motor-driven vibrator located in the handle of the tool and arranged to be felt by the operator of the tool. The vibrator may be configured to produce vibrations during an induction heating cycle, so the operator has a clear tactile indication that the tool is heating a plate and should not be moved until vibration stops, indicating the induction heating cycle has been completed. The vibratory feedback is useful in environments where the visual indication may not be in the operator's field of view and is easily discerned in environments with high ambient noise levels.

The disclosed hand-held induction heating tool may have a base configured to aid the operator in centering the induction coil of the tool over each bonding plate. The bonding plates are circular and have a raised, annular upper surface coated with heat activated adhesive. The depressed center of the plate includes a hole for a fastener that connects the plate and intervening rigid insulation to the roof deck structure. The head of the fastener is below the upper surface of the plate and does not come into contact with the roof membrane. The roofing membrane rests on each plate, resulting in a raised "bump" beneath the membrane.

According to aspects of the disclosure, the base of an embodiment of a hand-held induction heating tool defines a U-shaped depression open to the forward end of the tool.

This depression assists the operator of the tool with accurately positioning the tool's induction coil over the bonding plate before initiating an induction heating cycle. The opening at the front of the base receives the raised portion of the membrane where the membrane passes over the bonding plate, the sides of the depression guide movement of the tool to a position where the plate is positioned beneath the induction coil. The sides and curved rear part of the depression provide tactile feedback to the operator, who can feel the plate and raised part of the membrane move into position against the curved rear end of the depression.

An analog control circuit is disclosed in conjunction with the hand-held induction-heating tool. The analog control circuit employs comparators and analog logic to control actuation and operation of the circuit that generates the high frequency magnetic field in the induction coil. The disclosed hand-held induction heating tool includes a temperature sensor in the base of the tool that generates a temperature signal that fluctuates with the ambient temperature of the roof membrane. The hand-held induction heating tool includes a manual adjustment for increasing or decreasing the energy applied to a plate, with the setting of the manual adjustment providing an energy adjustment signal. The disclosed hand-held induction heating tool senses energy consumed at the induction heating coil and generates a power consumed signal. The analog control circuit is configured to employ the temperature signal, temperature adjustment signal, and energy consumed signal to control the length of time that the work coil is energized by the power inverter. According to aspects of the disclosure, the energy consumed signal is present only when the work coil is substantially aligned with a plate. The value of the energy consumed signal must have a pre-determined magnitude, or the heating cycle is terminated. This prevents a heating cycle from being applied when there is no plate present or the work coil is not substantially aligned with the plate.

BRIEF DESCRIPTION OF THE DRAWINGS

FIG. 15 is an exploded perspective view of an exemplary embodiment of a hand-held induction bonding tool according to aspects of the disclosure;

DETAILED DESCRIPTION

Figure 1:
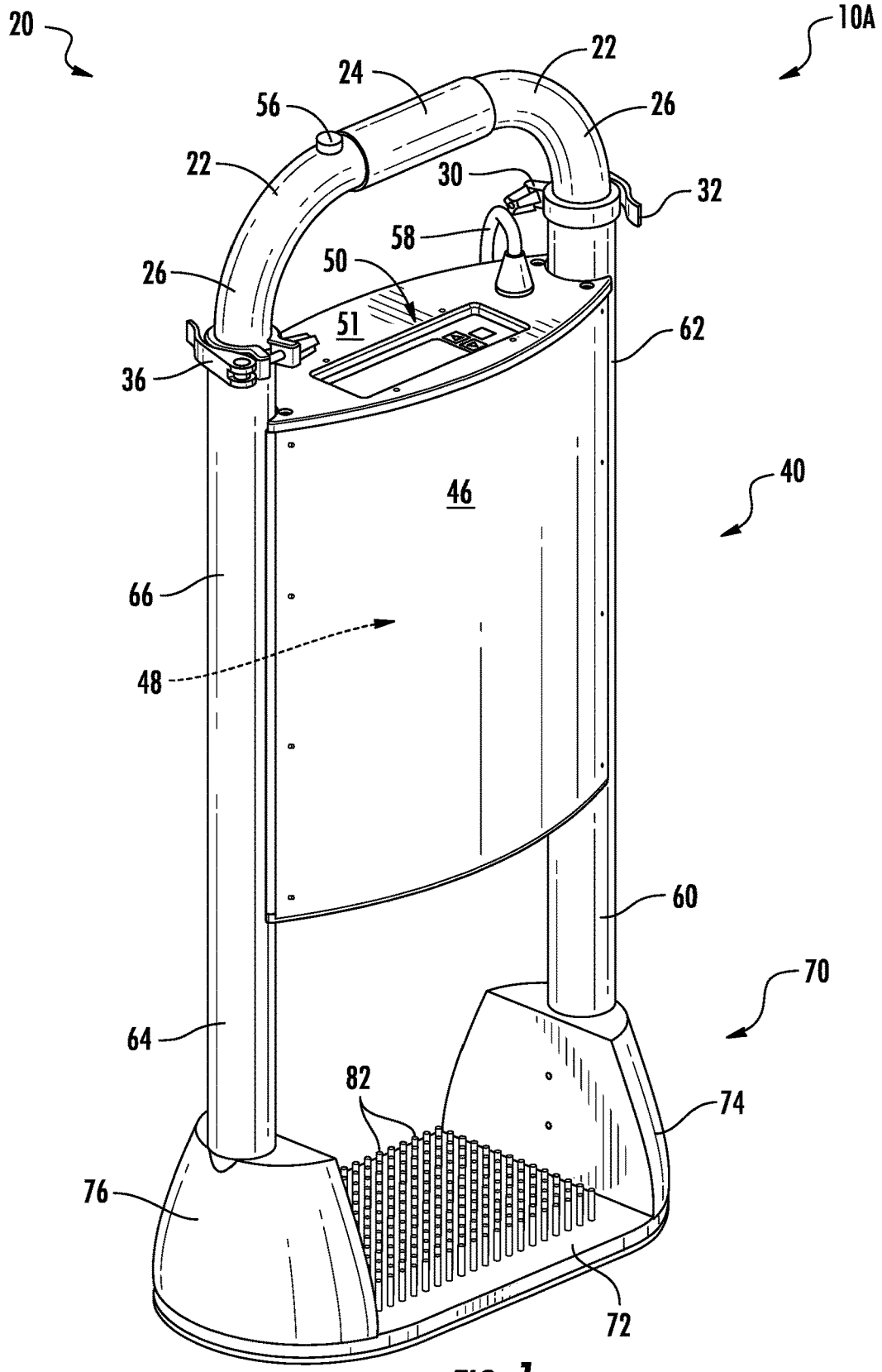
FIG. 1 (PRIOR ART)
FIG. 1 is a perspective view of a prior art portable heat induction tool to which the present disclosure relates.
Figure 2:
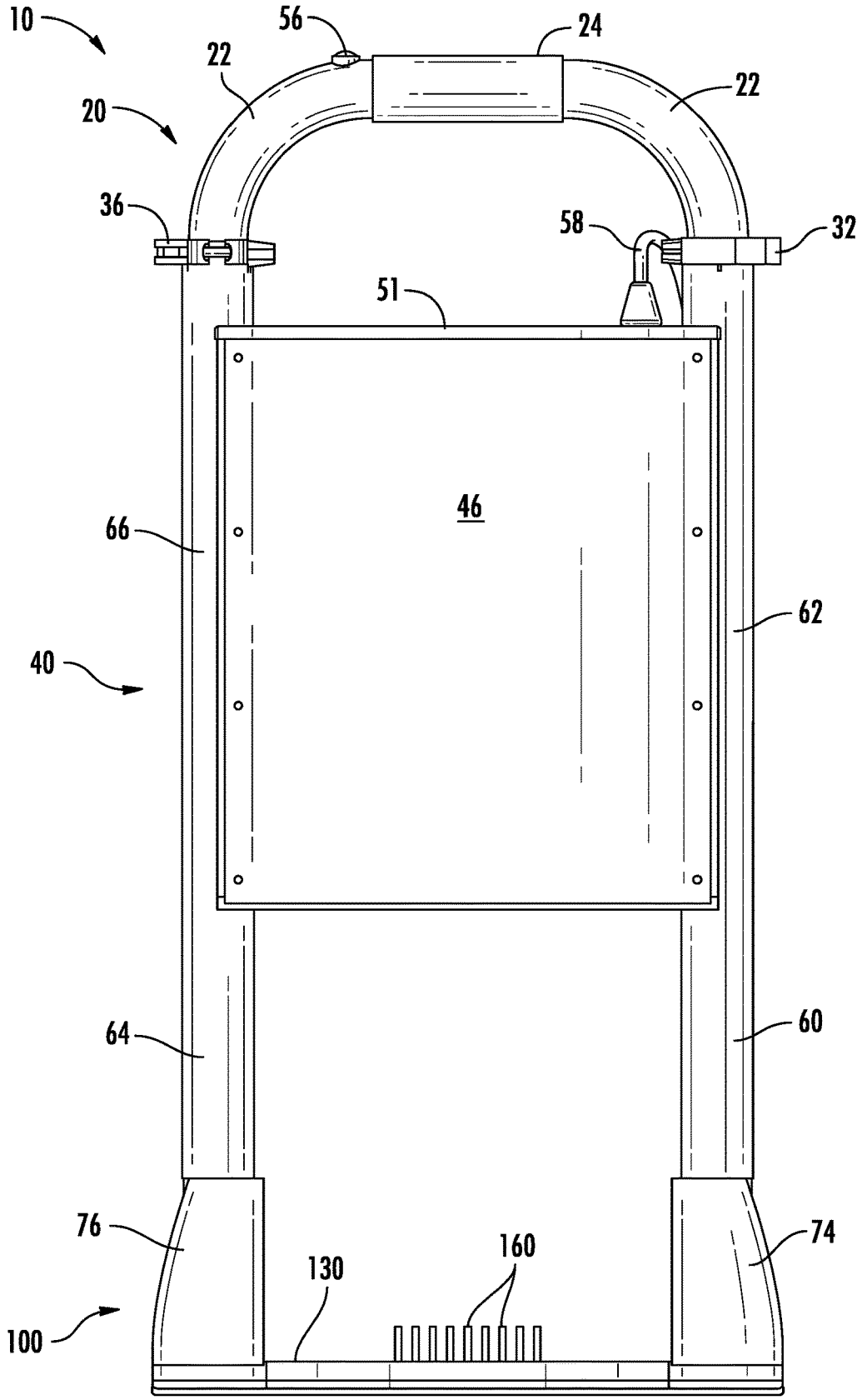
FIG. 2 is a front elevational view of a portable induction heating tool adapted for a foil roofing installation according to aspects of the disclosure.
Figure 3:
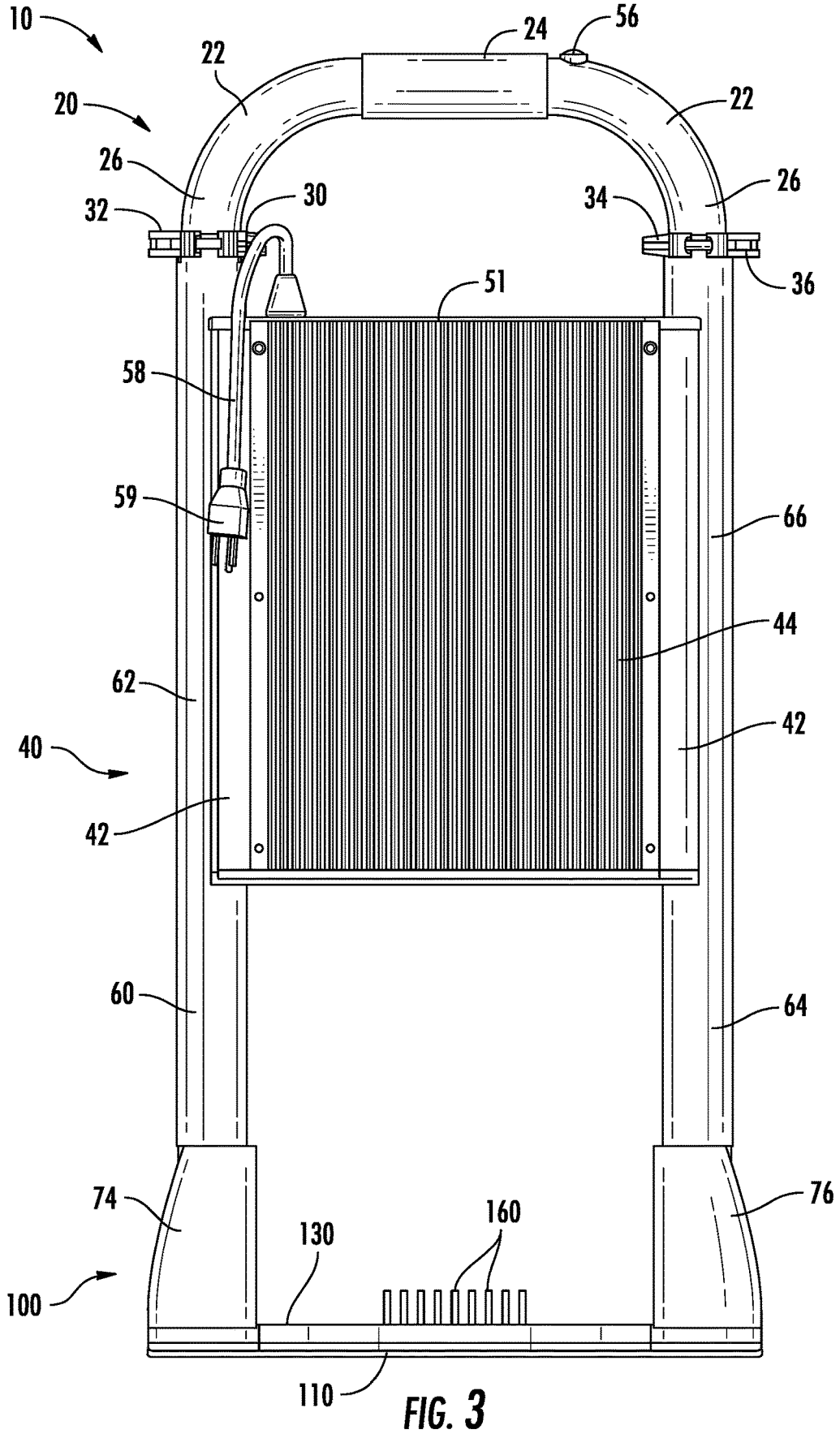
FIG. 3 is a rear elevational view of the tool of FIG. 2.
Figure 4:
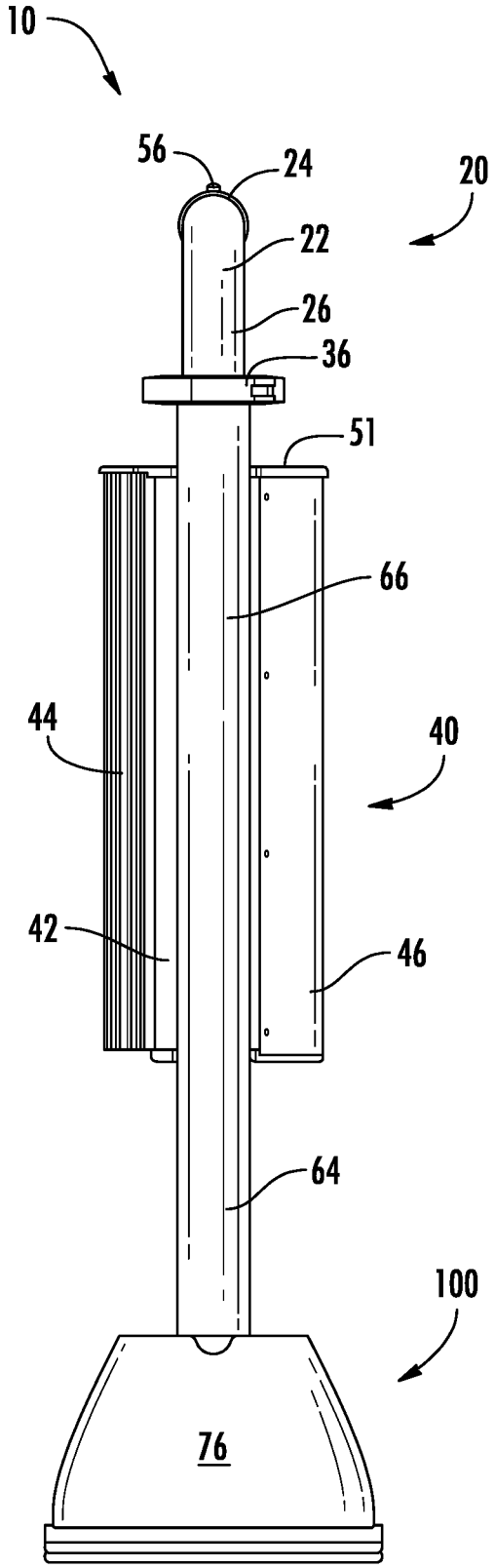
FIG. 4 is an elevational view from the right side of the tool of FIG. 2.
Figure 5:
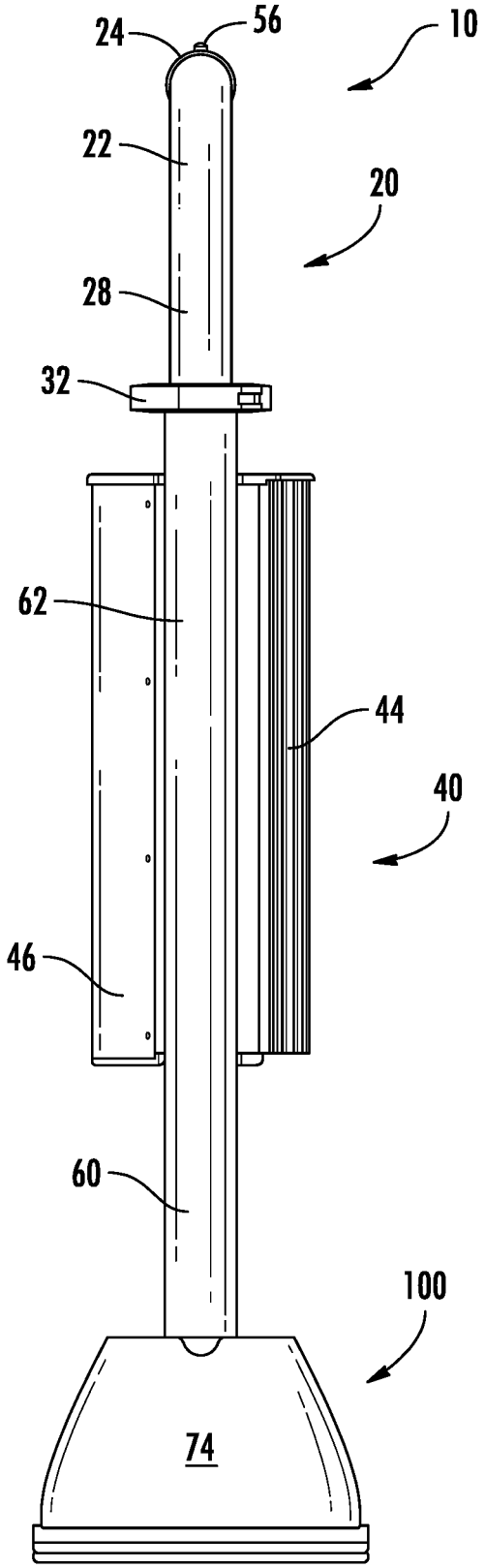
FIG. 5 is an elevational view from the left side of the tool of FIG. 2.
Figure 13:
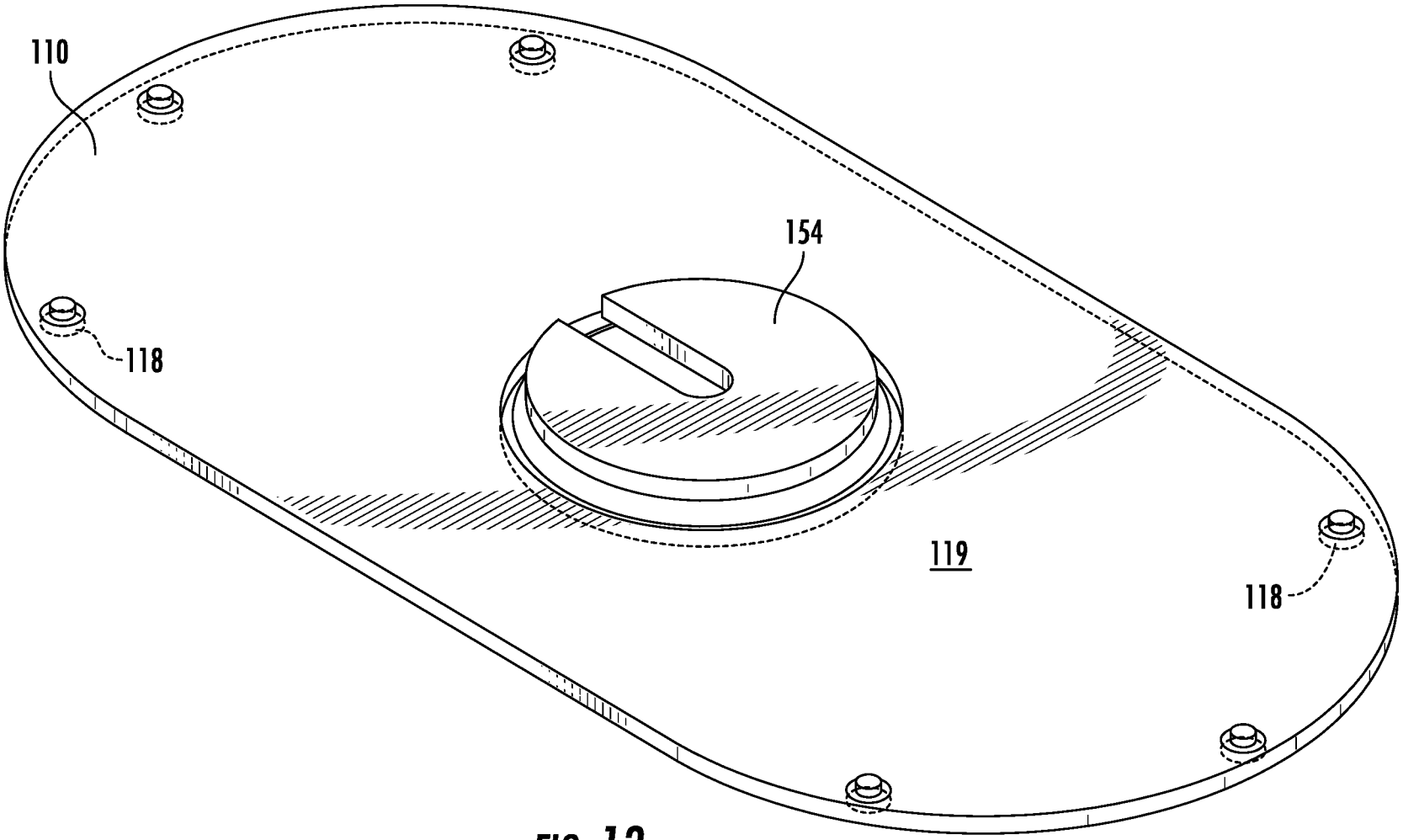
FIG. 13 is an enlarged top perspective view of a lower member of the base of FIG. 6, shown in functional conjunction with a dielectric spacer.

With reference to the accompanying drawings of FIGS. 2-12 wherein like numerals indicate the same elements throughout the views, a portable induction heating tool is generally designated by the numeral 10. The portable induction heating tool 10 incorporates a base 100 which is adapted for roofing applications including foil faced insulation as exemplified in FIG. 13. In addition, a related prior art portable induction heating tool is illustrated in FIG. 1 and designated by the numeral 10A.

The portable induction heating tool 10 is employed to heat anchor plates used in holding membrane roofs in position. The metal anchor plate functions as a susceptor and is inductively heated to activate the adhesive to bond the overlying membrane to the top of the metal plate. Induction heating tool 10 in an upright disposition has three major portions: a handle 20 (at an upper portion), a main body portion 40, and a base 100. The principal difference between induction heating tool 10 and the prior art as exemplified by representative induction heating tool 10A resides in the base 100. In heating tool 10A, the base is designate by the numeral 70.

The handle 20 includes an upper curved portion 22 that has a top grip 24. The handle 20 can be adjusted in length for ease of use by persons of different height. The two lowermost portions 26 of the handle 20 are depicted as being essentially vertical, where the lowermost portions 26 fit into a pair of vertical supports 62 and 66. The handle 20 can be extended, and one of those extensions is seen on FIG. 5, at the reference numeral 28.

Since the handle 20 has an adjustable length, the tool 10 has a pair of clamps 30 and 34 which are used to hold the handle 20 in position with respect to the vertical supports 62 and 66. The clamps 30 and 34 have pivotable cam arms 32 and 36 that can be released to adjust the height of the handle 20 with respect to the vertical supports 62 and 66. Once the user has moved the handle 20 to its proper height, the cam arms 32 and 36 can be tightened (i.e., pressed back against the clamps 30 and 34), thereby holding the vertical portions 26 (or 28) of the handle 20 in position with respect to the two vertical supports 62 and 66.

The central main body (or mid-portion) 40 of the tool 10 includes an outer housing 42 on one side that has a rather large array of heat sinks 44 at its mid-area that side of the mid-portion 40. On the opposite side of mid-portion 40 (see FIG. 2) the housing (or enclosure) depicted at reference numeral 46 is a cover (with no individual heat sinks thereon). The system controller and power supply are inside the mid-portion 40, and these electrical components are generally designated by the reference numeral 48, which are not visible in the figures. The reason for this is that the internal housing for the mid-portion 40 is completely sealed, and the electrical and electronic components cannot be seen from the outside of an assembled housing of tool 10.

The electrical components 48 are cooled by the heat sink array 44, by making mechanical contact with those heat sinks, thereby allowing heat transfer to occur by conduction (In other words, portions of the printed circuit board that holds the actual electrical components—including a casing that can surround a portion of the circuit board, if desired—can make physical contact with the base of the heat sink array 44, or can make contact with other heat conductive materials that will also make contact with the circuit board.). The entire heat sink array is designated by reference numeral 44, which comprises multiple individual "fin" heat sinks, including shorter fin heat sinks and longer fin heat sinks. The longer heat sinks 45 are not all of the same length, although any useful pattern of such heat sinks could be effectively utilized, without departing from the principles disclosed herein. The heat sinks are corrugated, to provide a larger surface area for convective cooling with the ambient air.

Using the type of construction described above and in the drawings, the portable induction heating tool 10 is designed to allow cooling air to reach the heat sink array 44, and those heat sinks are essentially directly coupled to the electrical components, using other heat-conductive structures. The "sealed" construction of the main body enclosure is essentially designed to deal with the harsh environment found in the typical roofing work environment, such as dust, debris, tar, and other "messy" materials.

The central portion 40 has a control panel 50 along its top surface 51, and an alphanumeric display screen 52 is located where a user may easily see messages that are displayed on the screen 52. There are user control pushbuttons 53 positioned adjacent to the display screen 52. In general, the pushbuttons 53 are used to scroll through various menus that are displayed on the screen 52, and to select or "enter" a particular control function once it has been displayed on the screen 52. The control buttons 53 may be flat-panel membrane switches or another type of low profile switch contacts; they are also sometimes referred to herein as a "plurality of user-actuated controls." Alternatively, screen 52 may be a touch screen and control buttons 53 may be configured as virtual buttons on the screen 52.

A heating cycle activation pushbutton 56 is also part of the user controls of the heating tool 10. This pushbutton 56 could be located in many different places, including on the upper control panel surface 50, if desired. However, in the illustrated embodiment, this activation pushbutton 56 is located on the handle portion 20, at a place that will be easily accessible to an operator of the induction heating tool 10. Pushbutton 56 is also sometimes referred to herein as a "manually-operable actuation device."

The induction heating tool 10 is electrically powered in the illustrated embodiment, and a power cord 58 is provided that enters the housing at the control panel surface 50. A plug 59 is provided at the end of the power cord 58. In the illustrated embodiment, the plug 59 is designed to interface into an electrical outlet or to an extension cord. For heating tools used in the United States and most North American geographic locations, the tool 10 will be powered by 120 volt AC line voltage. For European applications, the typical European A.C. voltage could be used instead, and the induction heating tool 10 will be provided with an appropriate power supply for the standard European voltage and frequency.

The middle portion of the induction heating tool 10 includes two vertical supports 62 and 66, as noted above. These supports extend further down at portions 60 and 64, respectively, which mechanically connect the upper and middle portions of the tool 10 to the base 100.

Figure 14:
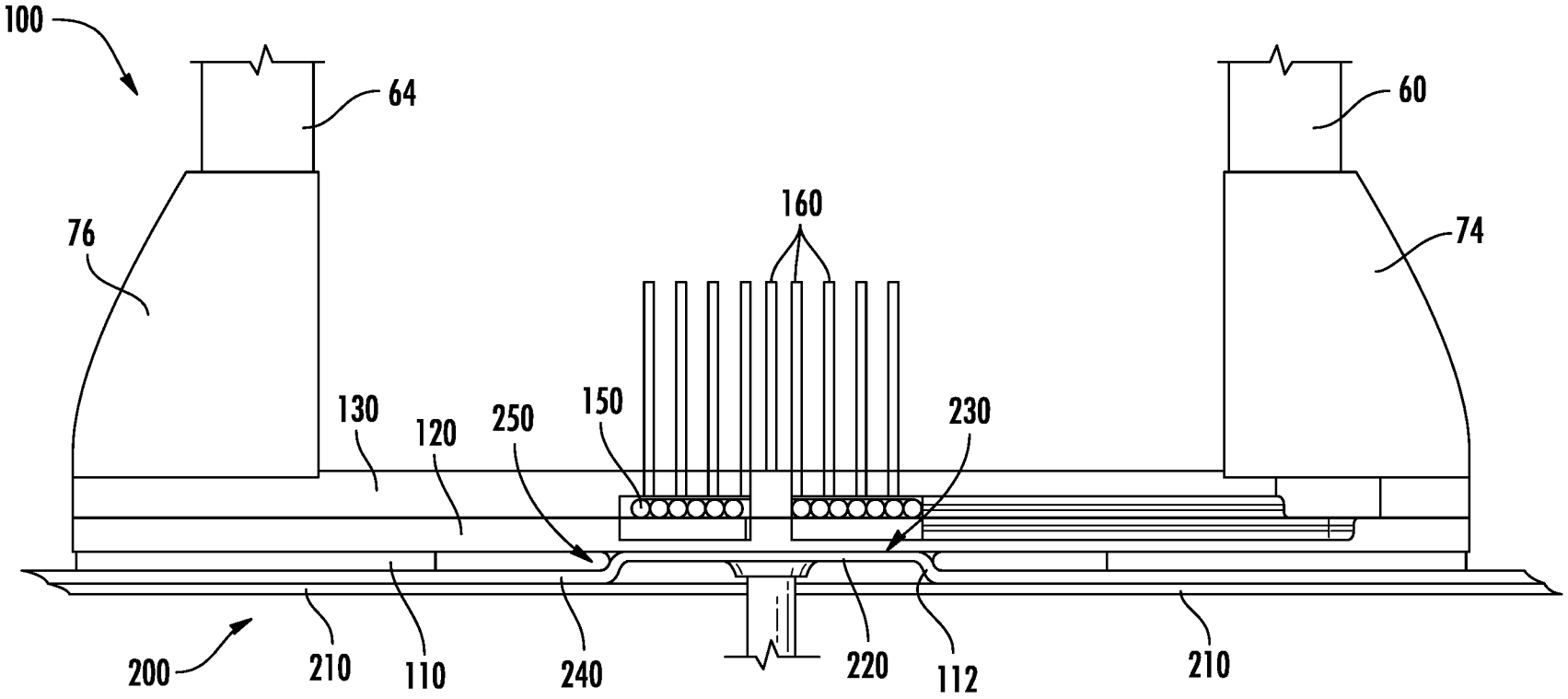
FIG. 14 is a side sectional view of a portion of a representative foil roof installation illustrating a protruding anchor plate and the base of a properly positioned induction heating tool.

With reference to FIG. 14, a representative roof installation 200, for which the base 100 is particularly adapted, is represented in somewhat exaggerated form. The roof contains an insulation material that may be covered by a thin aluminum foil 210. The anchor plate 220 is mounted above the foil using a fastener 221 extending through the insulation to engage a structural member of the roof (not shown). The anchor plate 220 has a heat-activated adhesive 230 disposed on an upward facing surface. A water-impervious membrane 240 is laid over the anchor plate 220 so that the anchor plate and its covering membrane 240 portion protrude slightly above the remaining flat surface of the roof to form a shallow mesa 250. The membrane 240 is typically 45-80 mils (each mil=1/1000 of an inch) in thickness. It will be appreciated that there are a multitude of anchor plates 220 preferably arranged in a grid across the roofing installation.

The base 100 is particularly adapted for installations which include a thin metal foil 210, but may also be used for installations that do not have a metal foil. The base 100 carries, protects and facilitates the positioning of the induction coil 150. First, the induction coil 150 is configured so that upon activation of an induction heating cycle, the magnetic field induction generally the same size and shape as the target anchor plate 220. The objective is to heat the metal anchor plate 220 sufficiently to activate the adhesive 230, while minimizing exposure of the surrounding foil to the magnetic field. A circular induction heating coil 150 is selected to have a diameter closely matched to the diameter of the anchor plate 220. When the coil 150 is centered over the anchor plate 220 during each induction heating cycle, exposure and heating of the surrounding foil is minimized.

The base includes a recess complementary to the protruding anchor plate 220/membrane 240 so that the proper positioning of the portable induction heating tool relative to the anchor plate may be positively tactilely detected upon positioning of the recess over the mesa 250. Third, the base further includes a transparent and/or translucent member 110 which provides a window 111 so that the underlying roof can be observed from above the tool and the position of the tool relative to the protruding anchor plate can be more easily achieved. Fourth, the foregoing induction heating process is accomplished in an efficient manner without requiring fans and complex moving parts to cool the heat induction tool by efficiently dissipating the heat via various fixed heat sink structures. Fifth, the induction tool can otherwise be configured to incorporate various desired features of the prior art.

With reference to FIGS. 6-12, the base 100 preferably has a generally oval shaped footprint and is configured to support the tool in a stable upright orientation on the roof. The base 100 is principally composed of three members, namely, a lower member 110, a medial member 120 and an upper member 130. The members are sandwiched together to provide a rugged base structure which is mounted to two vertical stand-off members 74 and 76 which mechanically connect to the bottommost portions of the vertical supports 60 and 64, respectively.

The lowermost member 110 (FIG. 9) includes a central recess 112. The recess 112 is dimensioned to receive the protruding anchor plate/membrane cover. The recess 112 is a rounded or chamfered inner rim 114 to provide a smooth glide-like reception of the protruding plate. The bottom surface 116 of the lower member is generally planar and includes counter-bored openings 118 for receiving the heads of fasteners for connecting with the stand-off members 74 and 76. The lower member 110 is preferably manufactured from a rugged acrylic or other rugged material which is essentially translucent or transparent. Clear plastic, Plexiglas and polycarbonate materials may also be had for member 110. The upper surface 119 is planar and engages in surface-to-surface relationship with the medial member 120.

The medial member 120 (FIG. 12) has a generally bowtie shape and includes a central shallow cylindrical recess 122. The recess 122 is generally dimensioned to be commensurate with the underside recess 112 of the lower member 110. The medial member also defines a longitudinal channel 124 for receiving an electrical cable for the coil 150. A central locating stud 126 projects centrally upwardly in the recess. The medial support member also includes bores 128 which align with the openings 118 of the lower member.

The upper support member 130 (FIGS. 7 and 11) preferably has a bowtie-shaped profile generally identical to that of member 120. The underside surface 136 is planar and engages against the upper surface 129 of the medial support member in generally surface-to-surface relationship. The central portion of the member has a shallow cylindrical recess 132 which is generally dimensioned to be commensurate to that of recess 122 and aligns therewith to form a cavity 140 (FIG. 8) upon mating of the members. A central locating stud 136 also projects centrally in the recess. A longitudinal slot or channel 134 extends radially and cooperates with channel 124. Channel 134 communicates with an opening 142 extending vertically through the member. Bores 138 also align with the bores 128 and 118 of the other members to each receive a fastener for securing together the base member and connecting same to the stand-off members 74 and 76. The upper surface of member 130 has planar shelves 131 for receiving the bottom ends of the stand-off members 74 and 76.

Figure 10:
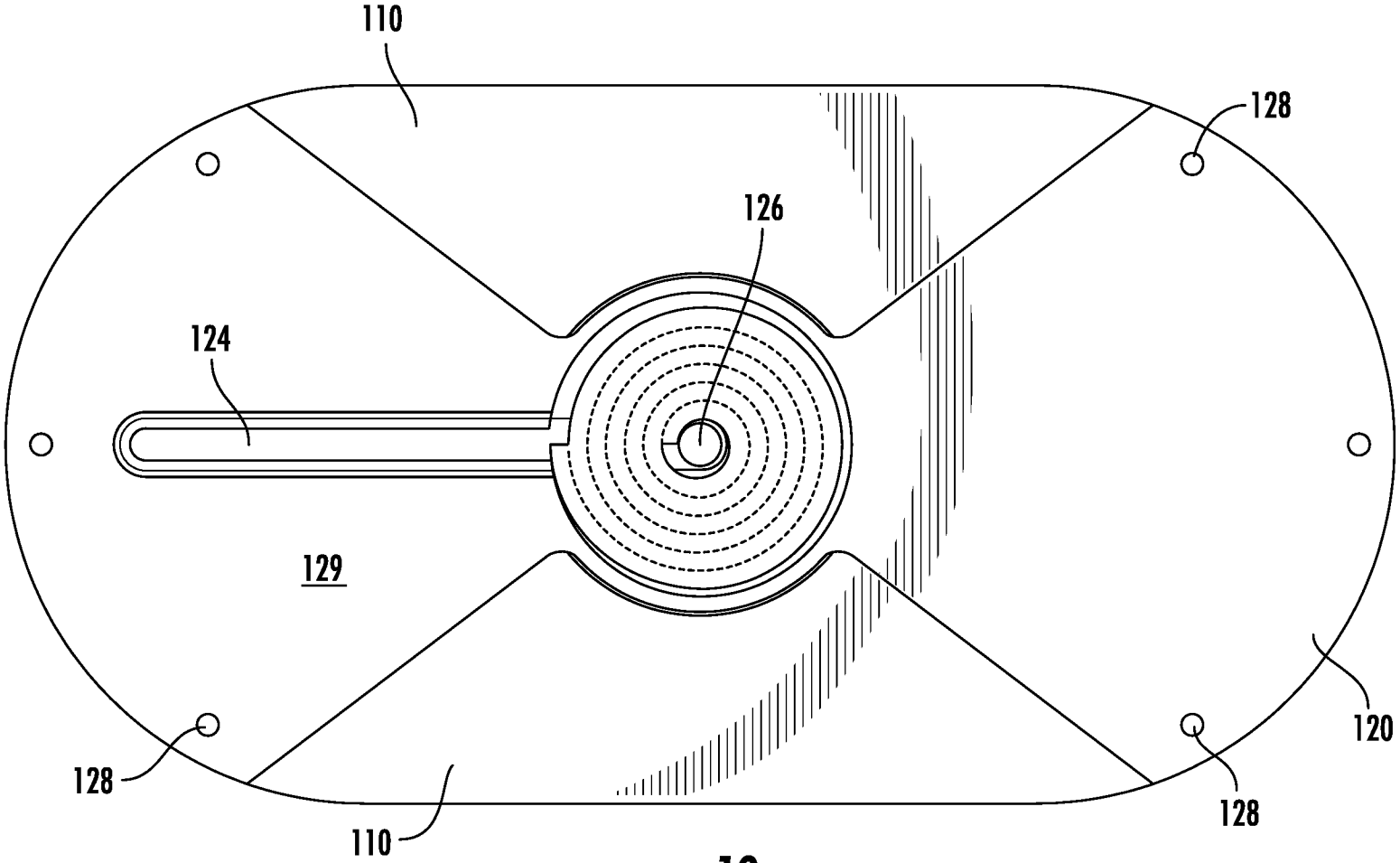
FIG. 10 is an enlarged top plan view of a partially assembled portion of the base portion of FIG. 6.
Figure 11:
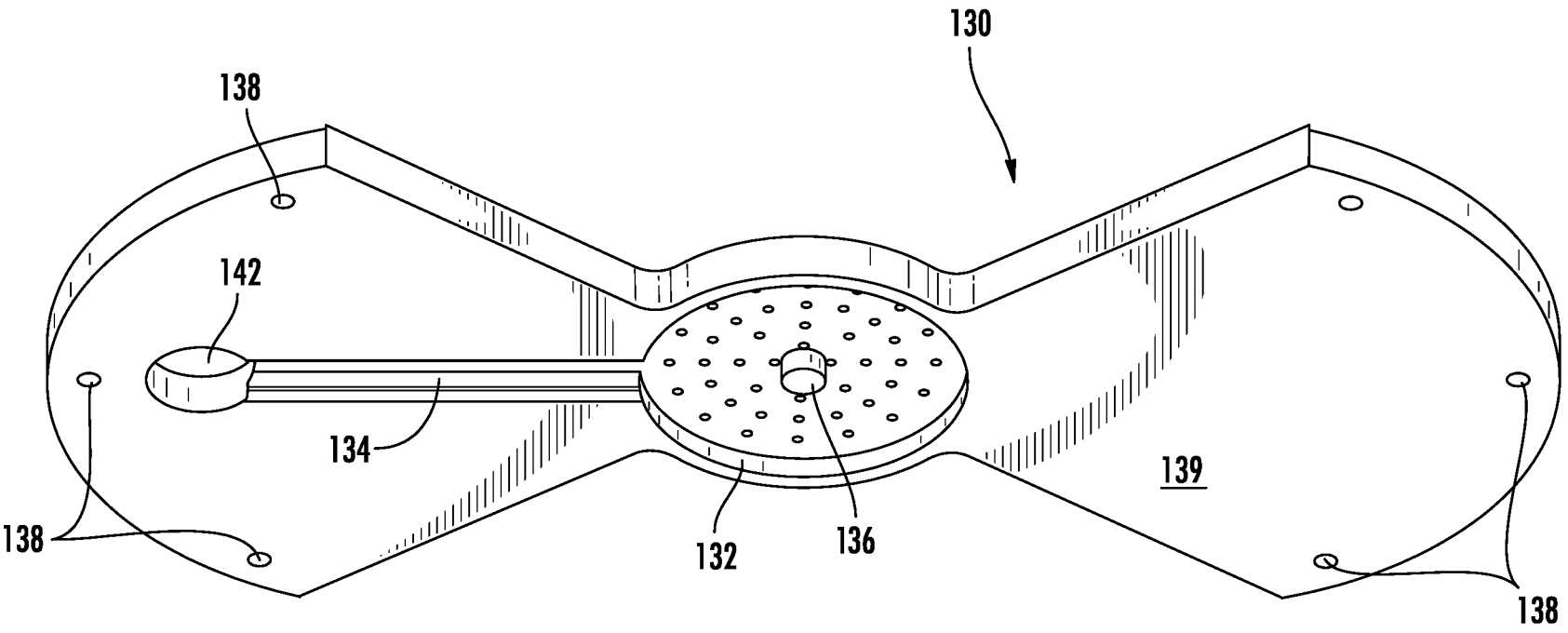
FIG. 11 is an enlarged underside perspective view of an upper component of the base of FIG. 6.
Figure 12:
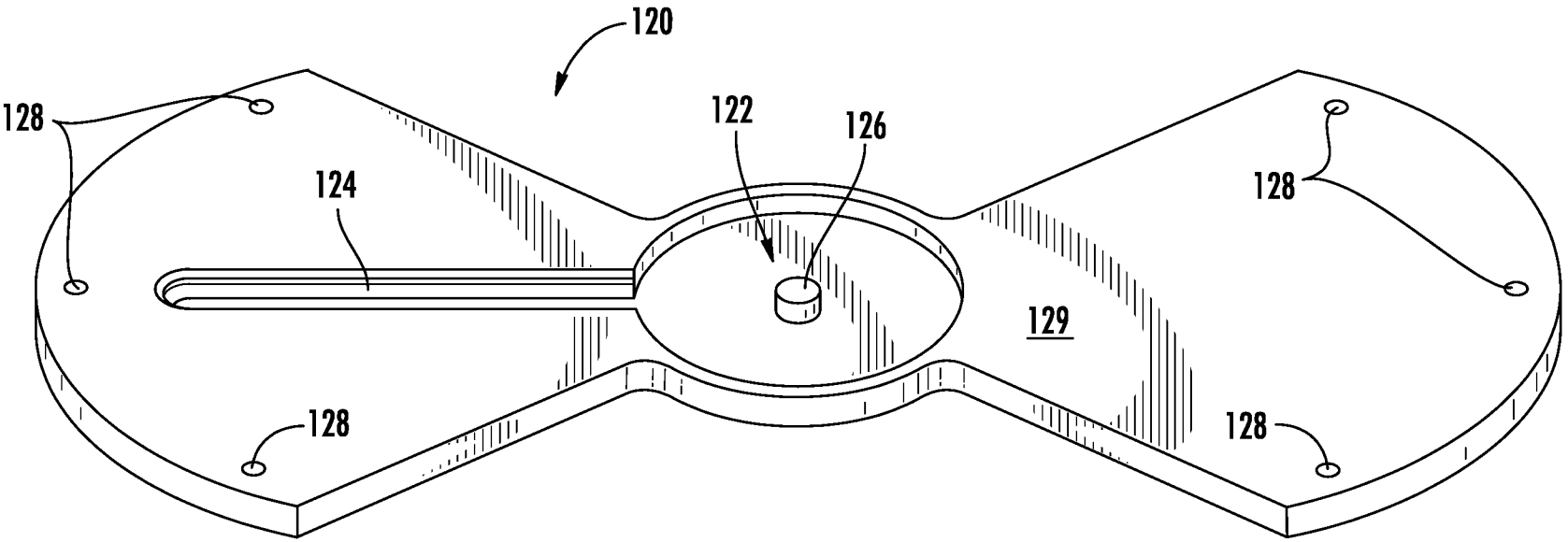
FIG. 12 is an enlarged top perspective view of a component for the base of FIG. 6 which engages against the component of FIG. 11.

With additional reference to FIG. 10, a single round or "pancake" induction coil 150 is received in the recess 132 and connects via an electrical cable extending through the slots 124 and 134 and opening 142 for electrical communication through the vertical support 64 and the standoff members 74. One embodiment of an induction heating coil 150 is constructed of 88 turns of a flat copper wire, selected to produce an intense magnetic field substantially in the same shape and size as the target anchor plate 220. Other coil configurations, such as a litz wire coil configuration are compatible with the disclosed induction heating tool. A dielectric spacer 154 is mounted in the recess 122 below the induction coil to provide an effective magnetic induction region for the coil. The spacer 154 may be manufactured from glass-filled epoxy high-temperature material. The upper member also includes a plurality of openings 156 which each receive heat induction pins 160. The pins 160 project upwardly through the top surface and thermally communicate with the coil 150 to provide an effective means for dissipating heat from the base.

Figure 6:
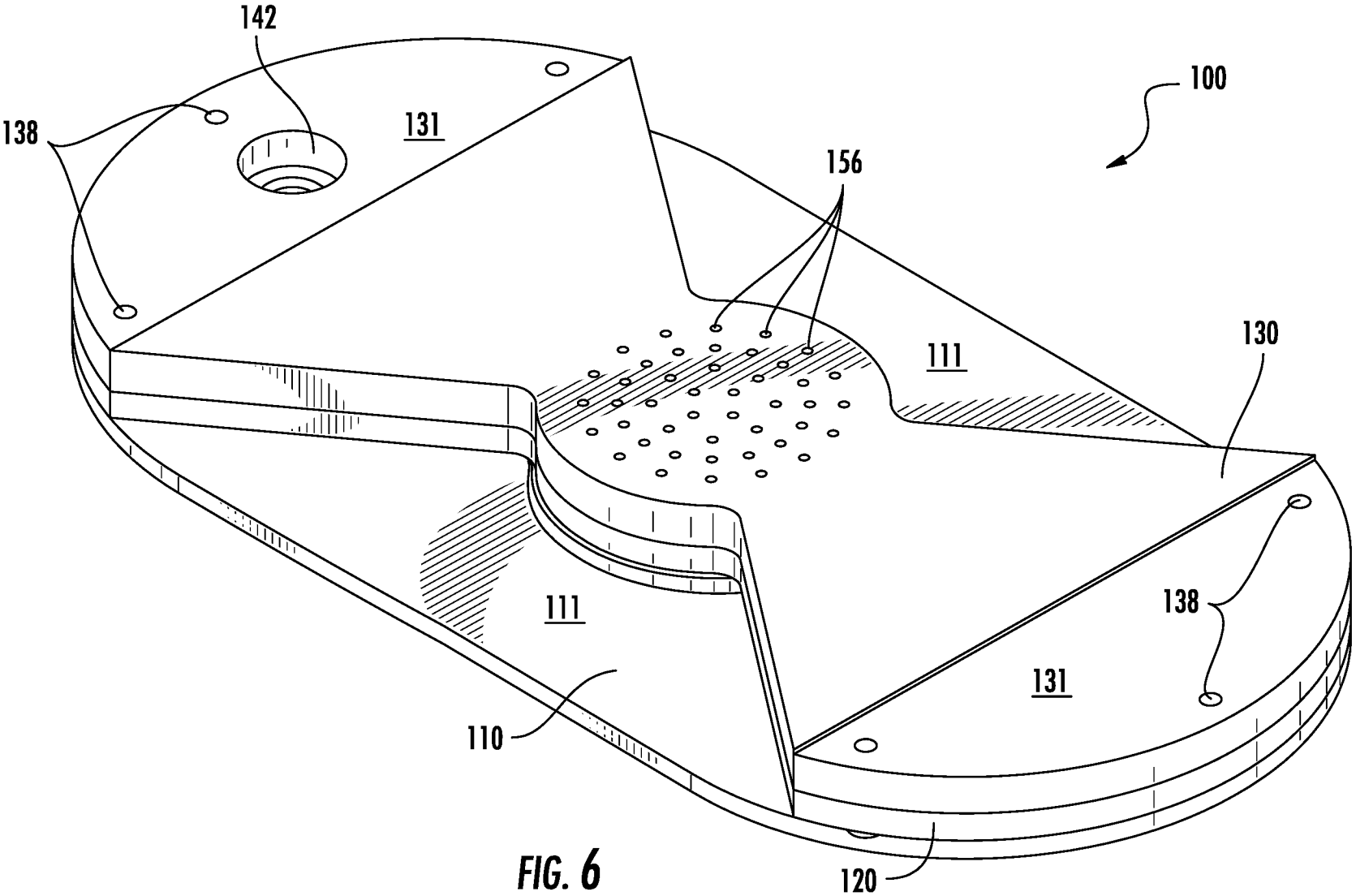
FIG. 6 is an enlarged perspective view of a base for the tool of FIG. 2.
Figure 7:
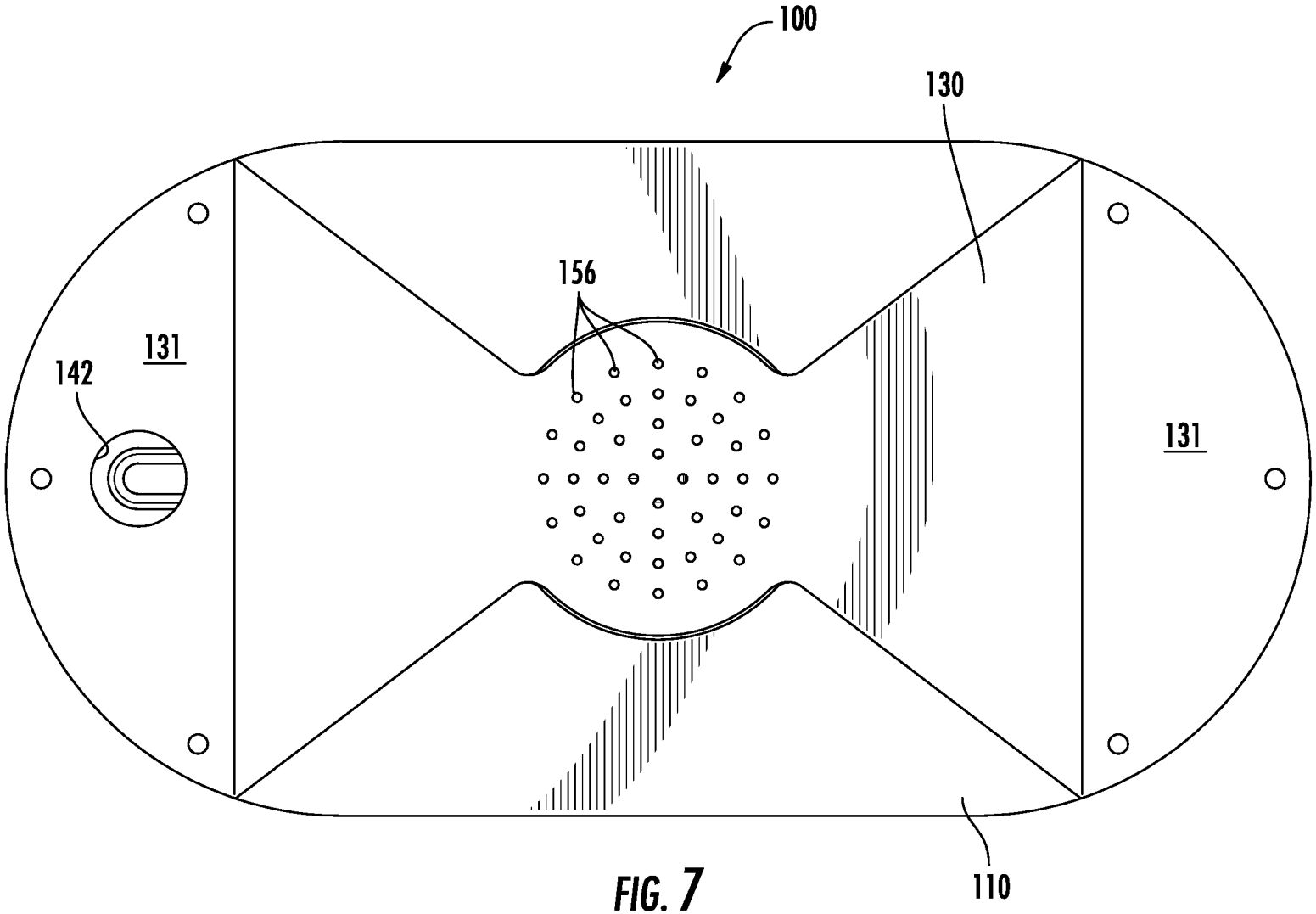
FIG. 7 is an enlarged top plan view of the base of FIG. 6.
Figure 8:
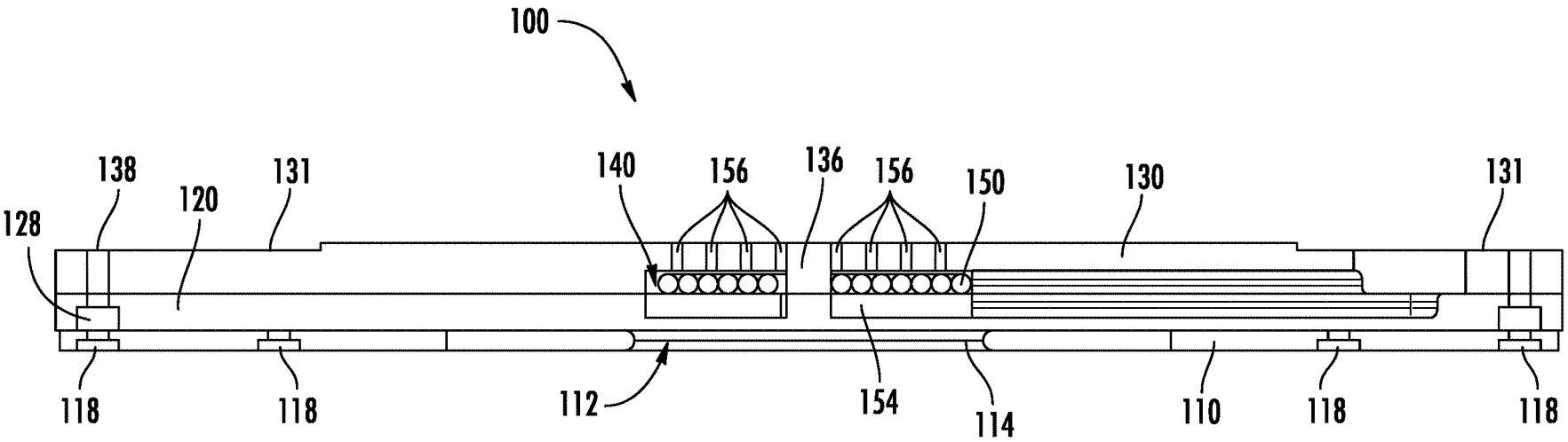
FIG. 8 is an enlarged central sectional view of the base of FIG. 6 taken from the rear thereof.
Figure 9:
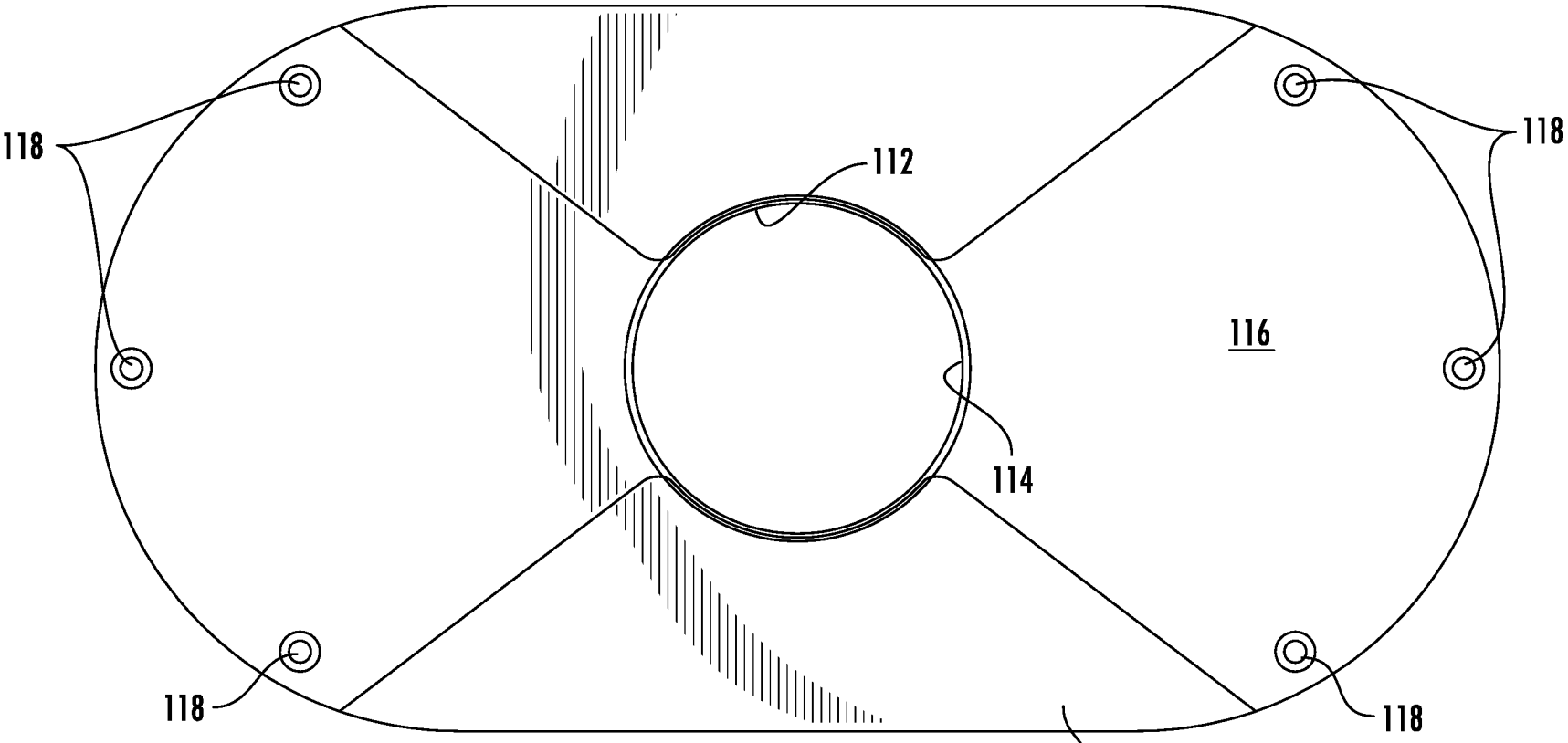
FIG. 9 is an enlarged bottom plan view of the base of FIGS. 2 and 6, with portions removed for clarity.

Base 100 has a bottom-most relatively flat (or planar) surface 116 (see FIG. 6). In the disclosed embodiment, member 110 is transparent so the operator may observe the membrane beneath the tool through portions of the upper surface 119 of member 110. The operator can see through member 110 to visually facilitate positioning of the induction coil 150 (located in recess 122) over an anchor plate 220.

Base 100 contains an induction heating coil 150 (which is disposed between the upper surface and the bottom-most planar portion of the base 100). There are two vertical support members 74 and 76 which act as stand-offs and as mechanical protection for the induction heating coil 150. These two stand-off members 74 and 76 mechanically connect to the bottom-most portions of the vertical supports 60 and 64.

The induction heating coil 150 tends to become hot when in use. Multiple rod-like heat sinks 160 extend through the upper surface of the base 100 to dissipate the heat. In the illustrated embodiment, these heat sinks 160 are small pin-type heat sinks (although other types of heat sinks could be used instead). Heat sinks 160 are located very close to the induction heating coil 150, and as such, allow for a substantial amount of cooling of the induction heating coil, without any moving parts. This same principle of operation is also used in the middle portion 40, in which the multiple heat sink elements are located proximal to the electrical components of the power supply, which provide a substantial cooling effect without any moving parts. In other words, the induction heating tool 10 has no fans or liquid cooling tubes (which are found in many conventional portable induction heaters). The rod-like heat sinks 160 of the illustrated embodiment are mounted on a substrate that is made of a dielectric material, so that this substrate can be in direct contact with the induction heating coil 150. This allows the heat sinks 160 of the heat sink subassembly to be physically very close to the induction coil 150, so that thermal energy can be effectively conducted away from the induction coil by the multiple heat sinks 160. In illustrated embodiment, the heat sink substrate is made of a glass-filled epoxy material.

Since the substrate of the heat sink subassembly is made of a dielectric material, it will not be raised in temperature due to any magnetic field effects that would otherwise be caused by the magnetic field emitted by the induction coil 150. The relatively small pin-type heat sinks 160 are also designed so that they will undergo very minimal heating from the magnetic field of the induction coil. In this manner, the heat sink subassembly mounted to the base portion 100 will effectively transfer heat from the induction coil 150, but at the same time not be affected to any major extent by the magnetic field emitted by induction coil 150. The rod-like pin heat sinks 160 are dimensioned and configured such that they do not get heated by the induction coil 150 during activation.

The induction heating tool 10 is designed to bond membrane roofing to coated steel anchor plates, in which the anchor plates are coated with a heat-activated adhesive that will affix the membrane layer to the steel anchor plates when the anchor plates themselves are raised in temperature by the magnetic field produced by the coil 150 of the induction heating tool 10. The heating tool 10 is designed so that it can be used by a person standing at all times, and may be referred to as a "stand-up" type of induction heating tool. The handle 20 can be picked up by a human hand, probably at the middle grippable portion 24, and lifted from one position to another on top of the membrane surface that is being applied to a roof.

The base portion 100 of tool 10 has a rather large predetermined footprint area so that the tool 10 will be stable, and can be left standing on a low slope roof. For example, the induction heating tool 10 is designed with a low center of gravity so that it can be used on an angled roof having a slope or grade as much as 2 parts in 12 (a 16.7% slope) which is a roof pitch angle of about 9.5 degrees.

Figure 14A:
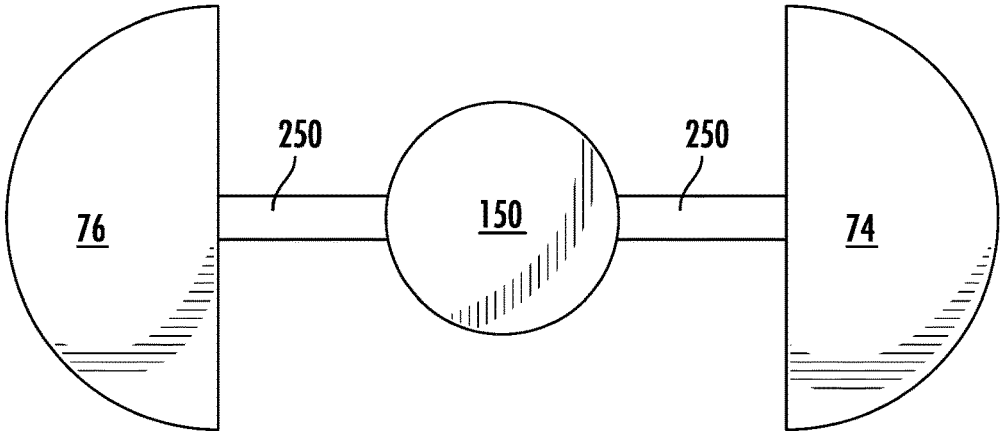
FIGS. 14A-14C schematically illustrate several alternative base configurations compatible with the disclosed induction heating tool.
Figure 14B:
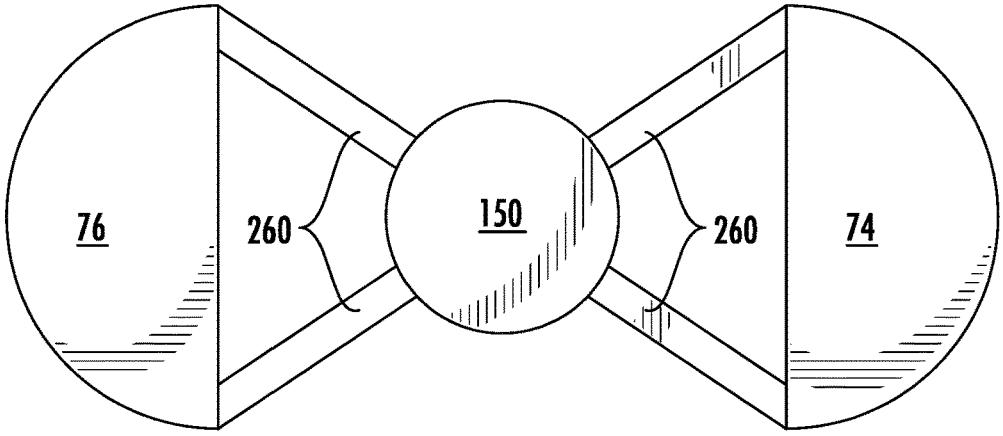
Figure 14C:
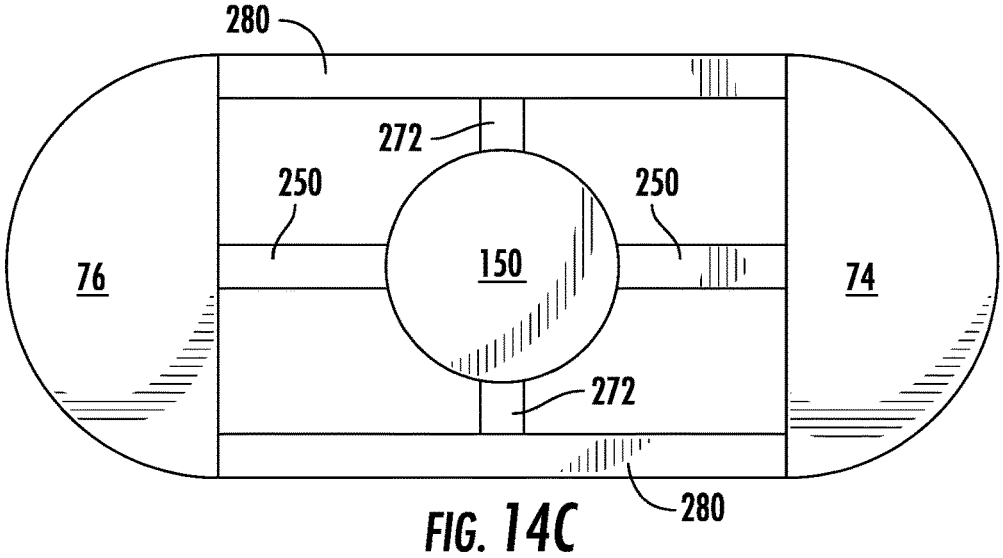
Figure 16:
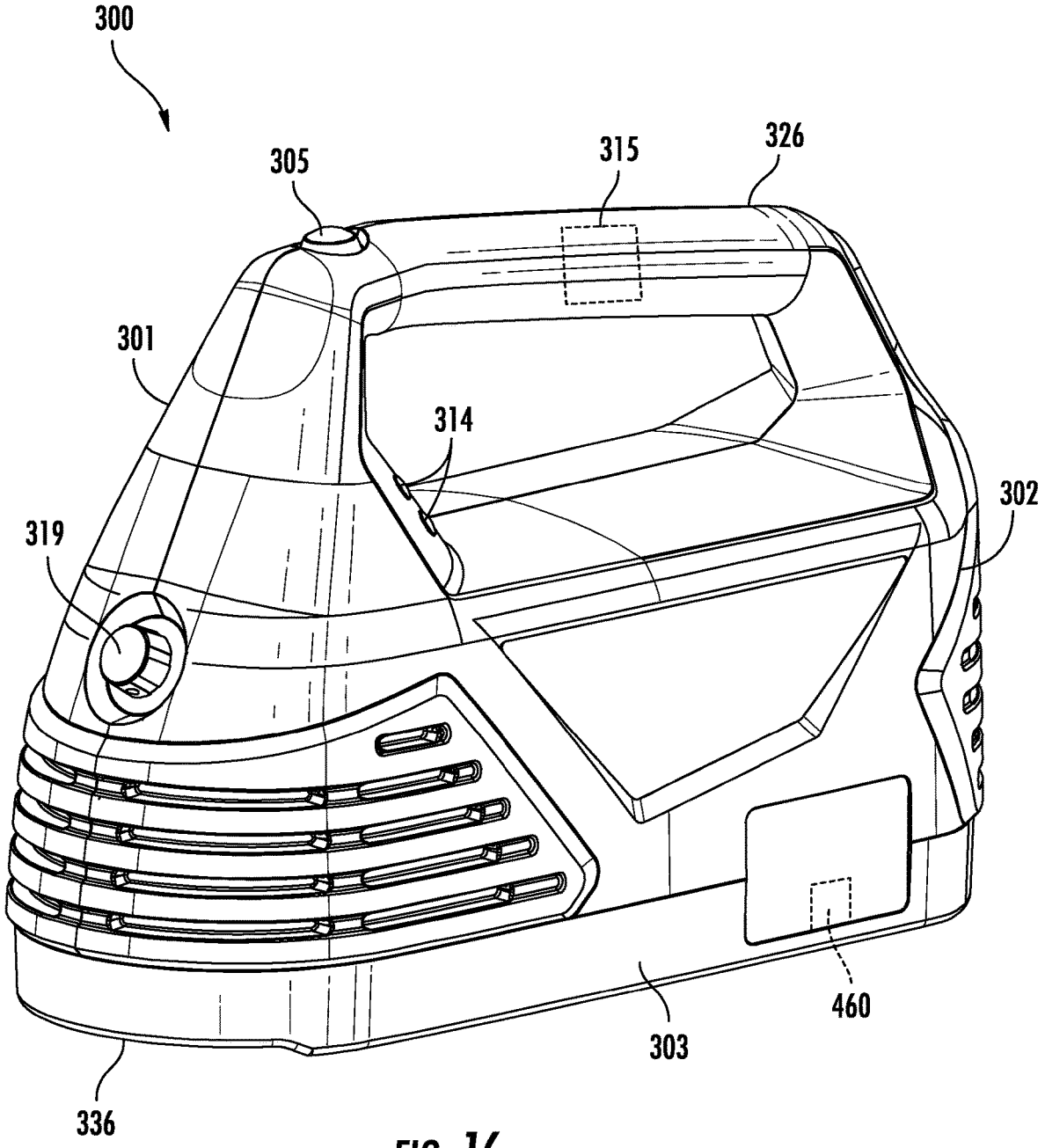
FIG. 16 is a perspective view of the hand-held induction bonding tool of FIG. 15 in a fully assembled condition.
Figure 17:
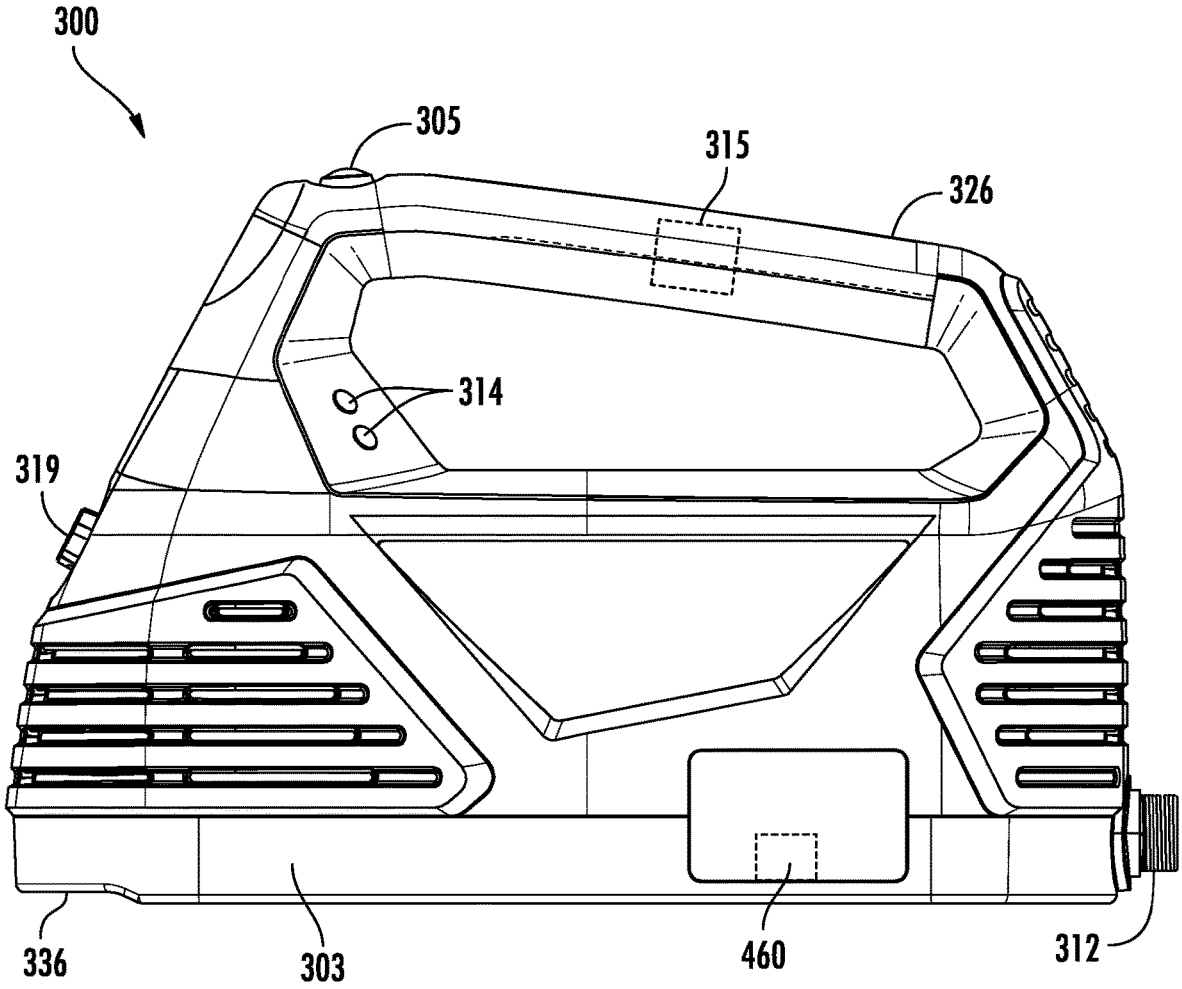
FIG. 17 is a side view of the hand-held induction bonding tool of FIGS. 15 and 16.

FIGS. 14A, 14B and 14C illustrate alternative configurations for the base of a stand-up induction heating tool. One objective of the base design is to provide the operator with an obvious indication of the location and size of the induction coil 150. Another objective is to allow the operator to see the area of the roof membrane immediately surrounding the induction coil 150. In the embodiment of FIGS. 6-14, this is accomplished by making the lower-most base member 110 transparent, so the roof membrane is exposed to the operator through the transparent member. Lower most base layer 110 may be omitted, and the coil 150 supported by other structures extending between base standoffs 74, 76 as shown in FIGS. 14A-14C. To avoid interactions with the magnetic field, structures supporting the induction coil 150 should be constructed of dielectric material such as plastic. In the embodiments shown in FIG. 14A-14C, support members 250, 260, 272 and 280 extend between standoffs 74, 76 to support the induction coil 150. The area between support members and surrounding the induction coil 150 is open, giving an operator an unobscured view of the roofing membrane.

Since the height of the handle 20 can be adjusted, the heating tool 10 can be used by operators of various heights, and can simply be picked up from one location and lifted to another location on the roof where it is placed over one of the anchor plates that will then be bonded to the membrane. The user will push the activation switch 56 and can walk away from that location while the heating tool 10 automatically energizes its induction coil 150 for the proper amount of time to correctly heat the steel anchor plate, thereby raising the temperature of the heat-activated adhesive (without burning that adhesive), and sufficiently heating it so that the adhesive melts and adheres to the bottom surface of the membrane layer.

The induction heating tool 10 has an adjustable energy setting, so that the user can control how much energy will be emitted by the magnetic field produced by the induction coil 150, over an activation cycle. This will allow the heating tool 10 to operate on roofs at different ambient temperatures, without either overheating or under heating the steel anchor plates with respect to the appropriate amount of heating required to activate the adhesive coating of the anchor plate. A control circuit such as disclosed in U.S. Pat. No. 6,509,555 is capable of automatically selecting the power level at which the coil 150 will be driven, and is also capable of automatically determining when the heating (activation) cycle has been completed, based upon this user setting of the adjustable energy setting for the anchor plates of this jobsite. These automatic control capabilities are disclosed in U.S. Pat. No. 6,509,555.

In a preferred embodiment, the user will have ten different incremental adjustments that can be selected using the pushbutton controls 53. The appropriate information will be displayed on the display screen 52, so the user can see which of the ten available settings is being selected (or has previously been selected). The user can merely press the activation button 56 once the unit has been placed in the proper position over one of the anchor plates, and the user can then walk away to perform another task.

Various capabilities and features, such as disclosed in U.S. Pat. Nos. 6,509,555 and 8,492,683, can be incorporated into the induction heating tool 10. The base 100 is very compatible with the many innovative features for prior portable induction heating tools, a few of which are described below.

In one mode, a single user can use two individual induction heating tools 10 on the same roof. Each heating tool is provided with an acoustic output device that provides the user with information as to when a heating activation cycle has started and when that cycle has completed. With two different induction heating tools on the same roof, the user can select one of the tools to use a first audible tone (i.e., selecting a first frequency for the first acoustic output device on the first tool), and for the second heating tool on the same roof, the user can select a second audible tone (i.e., a different audible frequency) for its second acoustic output device on the second tool. In that manner, the user can use two different induction heating tools simultaneously, and the user will know which tool is currently operating in a heating cycle, and will be able to tell which of the tools has completed a heating cycle, merely from listening to the audible sounds produced by the tools themselves.

It will be understood that users may operate two separate heating tools in which the sound wave-producing devices for both tools would emit the exact same audible frequency, if desired. For example, the first tool on a particular roofing jobsite could emit "short" beeps at a frequency #1, while the second heating tool on the same roof jobsite could be emitting "long" beeps substantially at the same frequency #1. At first, it may be somewhat more difficult for the user to understand which tool is emitting the beeps, but with a short amount of practice, the user would quickly understand that the short beeps are coming from the first tool while the long beeps are coming from the second tool. The pattern of beeps could still be the same, i.e., a single long or short beep would have the same meaning for the two different tools (e.g., at the beginning of an activation cycle). Dual beeps could occur for both tools at the end of an activation cycle, if desired, and the dual beeps would be two short beeps for the first tool and two long beeps for the second tool, and so on.

In a further embodiment, the two separate tools could be using substantially the same audible frequency, in which one of the tools emits "steady" tones while the second tool emits "warbling" tones.

In other words, various different sound patterns at the same audible frequency for two different tools on the same roof jobsite can be used, instead of different frequencies of tones.

In yet another embodiment, induction heating tool #1 could produce a music chord, such as a major fifth chord (e.g., C, E, G) or a minor fifth chord (e.g., C, E-flat, G), while induction heating tool #2 emits only a single note. This certainly would allow a user to easily discern the individual operation of both tools, while on the same roof jobsite.

The user may select which energy setting is to be used for the particular jobsite. The energy setting can take into effect the ambient temperature at the roof, as of when the user is actually going to use induction tool 10 to seal a membrane roof to its anchor plates. In a preferred mode of operation, the user has ten (10) different settings for selecting the energy level at which the tool will be used. On the display screen 52, the user will have a menu of choices and can scroll up or down using the pushbuttons 53. When the user has selected the energy setting that is desired, the user can depress the correct pushbutton 53, and that energy setting will be used for the next run of heating events by operating tool 10.

In one embodiment, the user enters the number of discs that are going to be used on this particular jobsite. The number of discs is determined by the roof size and the density of anchor plates that are to be used for a particular membrane roof. If, for example the roof is rectangular, and there would be twenty (20) discs in one direction (along one edge of the roof), and thirty (30) discs along the other direction (along the other edge of the roof), then there would be six hundred (600) total discs for this roof. That is the number the user can select using the user pushbuttons 53.

The user may also perform data logging functions, if desired. At this step, the user can inspect values stored in a memory circuit used with the processing circuit of the electronic controller 48. Some of the information stored in memory can include the number of activations of this induction heating tool 10 throughout its lifetime, the number of discs that have already been "sealed" on this particular jobsite, the number of discs that remain to be sealed on this jobsite, and also the number of "faults" that have occurred on this jobsite. In addition, the data log can also store in memory other important information, such as the time and date of when the energy setting has been changed, and to what new value (i.e., the values between one and ten) for the energy setting.

Other information can also be stored, such as the time and date for beginning the sealing of a particular roof (or jobsite), and also the time and date when the job ends for sealing a particular roof (or jobsite). In addition, the data log can also be programmed to contain the time and date of particular faults, as well as the type of fault.

The electrical components of tool 10 also require "high voltage" power components, so as to provide sufficient power to drive the induction coil 150. A relatively high voltage power supply is provided, starting with a rectifier circuit, which supplies power to a DC-to-DC converter. The DC: DC converter supplies power to a power oscillator circuit, which directly drives the induction coil 150. The CPU controls the power output setting of the inverter circuit, which in turn effectively controls the power settings of the power oscillator circuit and coil driver circuit. It should be noted that the power setting of tool 10 is automatically controlled so as to properly activate (or "heat") the target anchor plate, which is a metal susceptor that creates eddy currents when exposed to a magnetic field (such as that produced by induction coil 150.

Details of the types of circuit designs that can be used for the purposes discussed above are found in other co-owned U.S. patents and pending patent applications, including: U.S. Pat. No. 6,509,555, issued Jan. 23, 2003, titled: "HAND HELD INDUCTION TOOL;" U.S. Pat. No. 6,875,966 issued on Apr. 5, 2005, titled: "PORTABLE INDUCTION HEATING TOOL FOR SOLDERING PIPES;" and U.S. Pat. No. 7,399,949, issued on Jul. 15, 2008, titled: "METHOD AND APPARATUS FOR ATTACHING A MEMBRANE ROOF USING INDUCTION HEATING OF A SUSCEPTOR".

FIGS. 15-22 illustrate an alternative hand-held induction heating tool for use in locations where it is impractical or impossible to use a stand-up induction heating tool such as that disclosed in FIGS. 1-14. The hand-held tool of FIGS. 15-22 is compatible with the membrane roofing systems, materials and bonding plates described with respect to the stand-up tool of FIGS. 1-14. The disclosed hand-held induction bonding tool 300, is a compact, self-contained tool for inductively heating bonding plates positioned beneath a roofing membrane. The tool 300 is constructed from mating left and right housing parts 301, 302 molded of ABS plastic. The base 303 is molded from plastic that is capable of resisting high temperatures, such as ULTEM 1010, from Stratasys, of Rehovot, Israel. The housing 301, 302, is configured to project upwardly from and rest upright on the base 303, with a handle 326 arranged to be grasped by the user to move and operate the tool 300. An actuation switch 305 is situated on the top of the handle, toward the front end of the tool 300. A heat adjustment knob 319 is located on the front end of the tool 300, allowing the user to adjust a potentiometer 316 to increase or decrease the quantity of energy delivered to a bonding plate 340. The handle contains a vibration motor 315 that generates a vibratory feedback to the user during an induction heating cycle. LED lights 314 are positioned on both sides of the tool 300, so they are visible whether the tool 300 is operated with the left or right hand. Each LED 314 includes a lens 317 secured to the housing 301, 302 by a lock ring. The lens 317 projects the light over a wide range of angles, making the LEDs visible from a range of vantage points around the tool 300.

Figure 21:
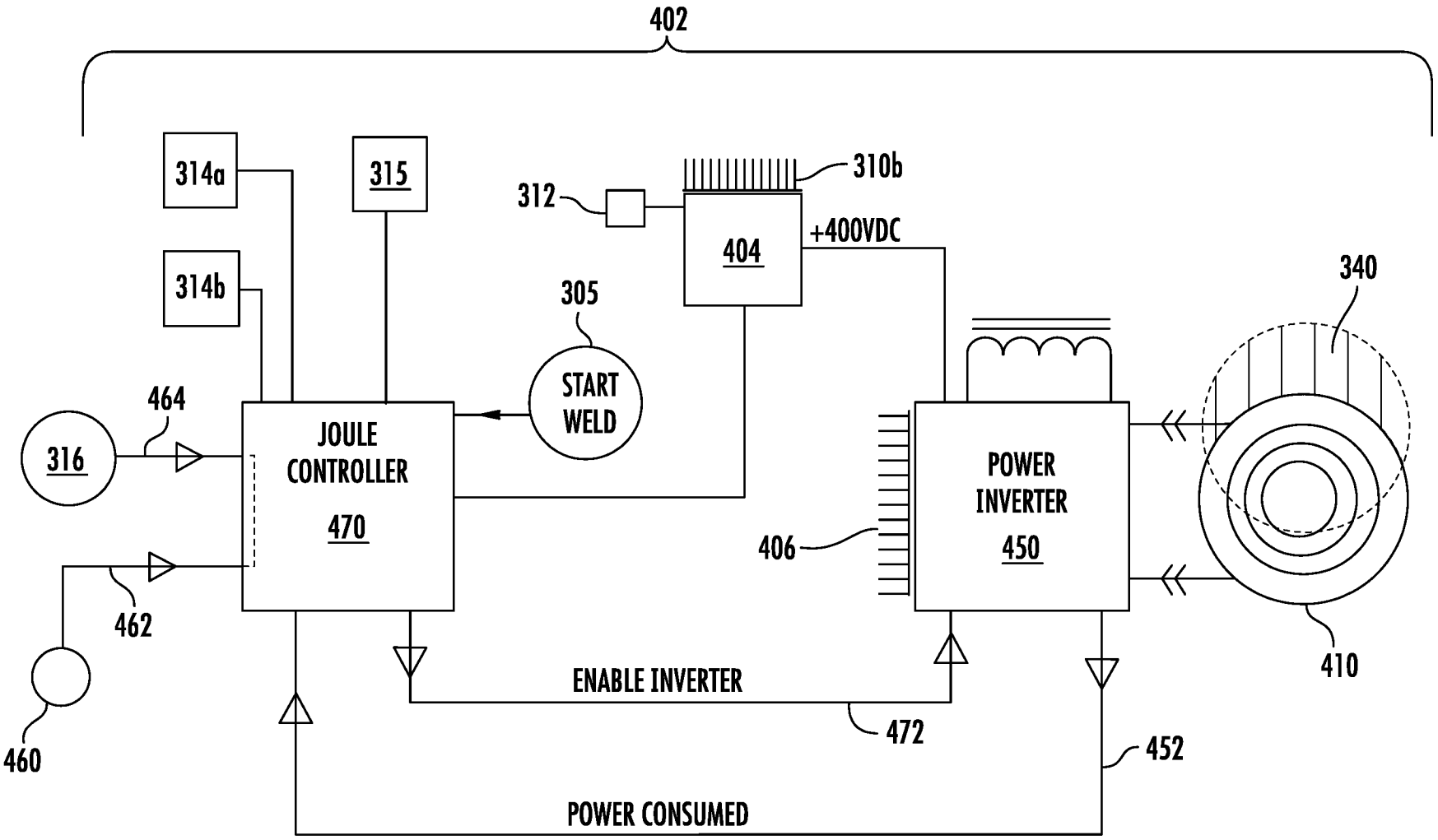
FIG. 21 is a functional block diagram of one embodiment of the hand-held induction bonding tool, according to aspects of the disclosure.
Figure 22:
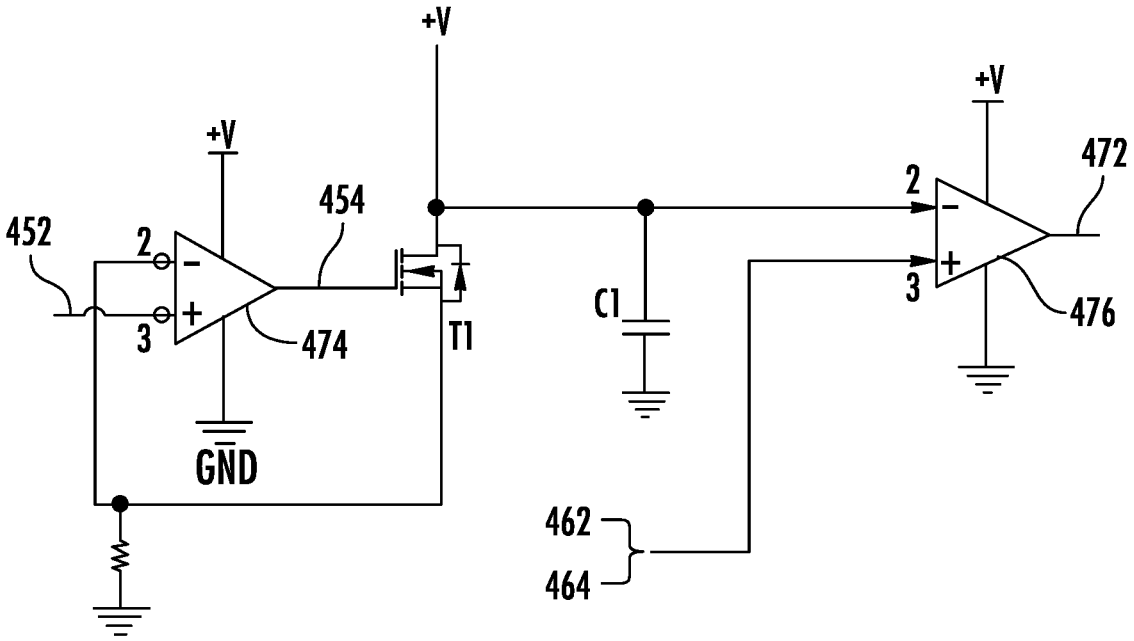
FIG. 22 is a partial, simplified, schematic of a joule controller according to aspects of the present disclosure.

The tool 300 includes electronic circuitry 402 that performs several functions, as shown in FIG. 21. The electronic circuitry 402 includes a power supply 404 that receives input power through a coupling 312 and generates power of different voltage and current for use by other parts of the tool 300. Low voltage DC is distributed as needed for integrated circuits including operational amplifiers, oscillators and other logic components. Low voltage DC power is also used to illuminate the LED lights 314*a* (green) and 314*b* (red) and power the vibration motor 315. LED light 314*a* is lit when the tool 300 has power and is ready to initiate an induction heating cycle. LED light 314*b* and vibration motor 315 are operational for the duration of an induction heating cycle. An "induction heating cycle" refers to a period of time after the operator actuates the switch 305, during which an oscillating electric energy is applied to the working coil 410 of the induction heating tool 300. During the induction heating cycle, the working coil 410 projects an oscillating magnetic field that creates eddy currents in the bonding plate 40, heating the plate.

The power supply 404 also generates high voltage (400 VDC) at roughly 2A current for use by a power inverter circuit 450. The power supply 404 and power inverter circuit 450 include components such as inductors, capacitors, and power transistors that generate significant amounts of heat. Heat generating components of the power supply 404 and power inverter circuit 450 may be thermally coupled to a heat sink 406 that includes fins to enhance the heat emitting surface area of the heat sink as is known in the art. A cooling fan 311 is mounted at a rear end of the tool 300 in a position to pull air through openings in the housing 301, 302, across the electronic circuitry 402 on PC board 313 and heat sink 406 to remove heat and prevent overheating of the electronic circuitry 402.

Figure 18:
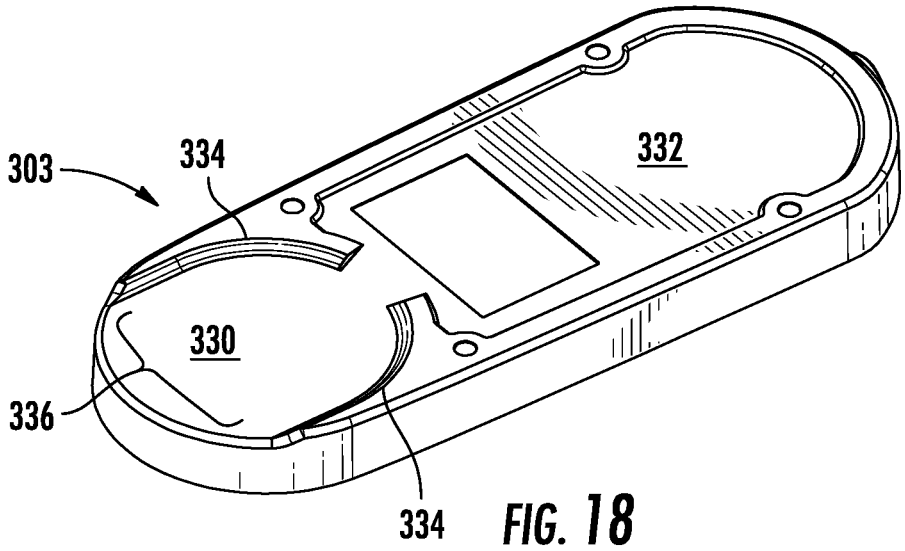
FIG. 18 is a bottom, perspective view of the base of the hand-held induction bonding tool of FIGS. 15-17.
Figure 19:
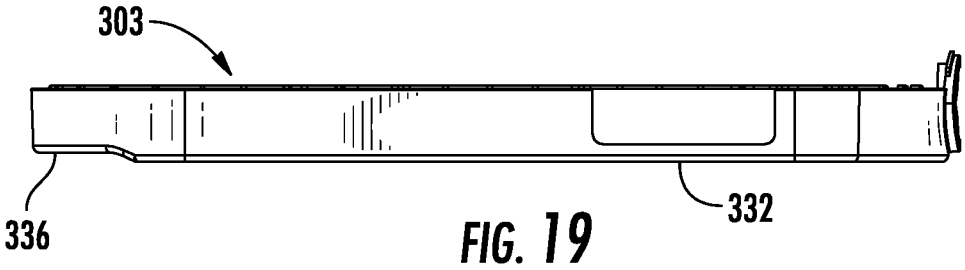
FIG. 19 is a side view of the base of FIG. 18, with the bottom surface of the base facing in a downward direction.
Figure 20:
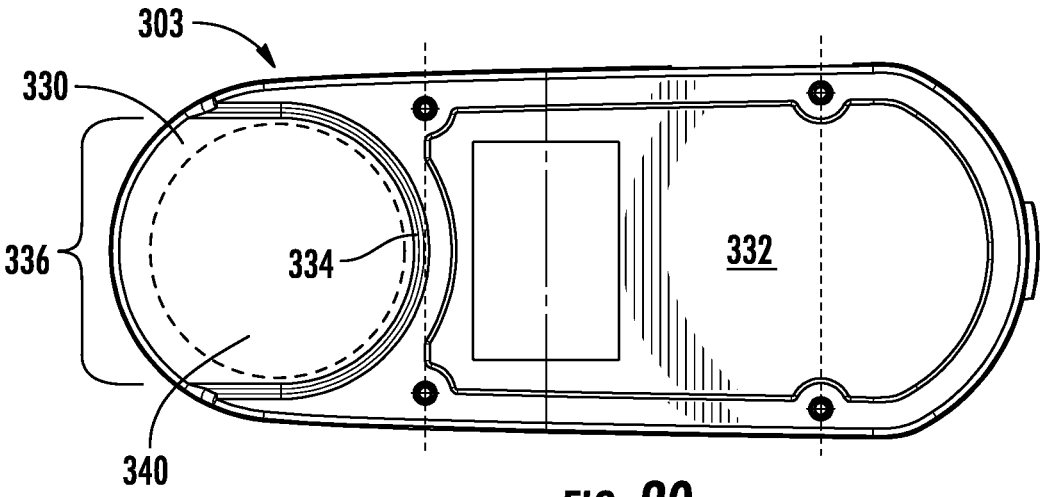
FIG. 20 is a bottom perspective view of the base of FIGS. 18 and 19.

A work coil 410 is positioned in the base 303, at the front end of the tool 300, as shown in FIG. 15. When energized by the power inverter circuit 450, the work coil 410 generates an oscillating magnetic field to inductively heat a bonding plate. The work coil 410 is mounted to the heat resistant base 303 in a position aligned with a recess 330 defined on the bottom (support) surface 332 of the base 303. The recess 330 is delineated by a curved wall 334 projecting from the bottom surface 332 of the base 303. The wall 334 may be continuous as shown in FIG. 20, or may be interrupted as shown in FIG. 18. Although a curved wall 334 defining a semicircular recess 330 is shown, other wall and recess shapes are compatible with the disclosed tool 300. Straight, angled walls or wall segments may be used to define a recess 330 aligned with the work coil 410.

The terms "align" and "aligned" are used in this application to refer to the relative position of the work coil 410 with respect to the recess 330 in the base 303 and also to the relative position of the work coil 410 with respect to a bonding plate 220, 340 when the tool 300 is in use. The position of the work coil 410 in the tool 300 is concentric with the recess 330 defined by wall 334. This increases the likelihood that the work coil 410 is also concentrically aligned over a bonding plate 220, 340 when in use, as described below. The flat roof substrate and base 303 of the tool 300 position the work coil 410 close to and parallel with the bonding plate 220, 340 when the tool 300 is in use. The work coil 410 is "aligned" with the bonding plate 220, 340, when the work coil is concentric with the bonding plate 220, 340. The work coil is "substantially aligned" with the bonding plate when there is substantial overlap between the work coil 410 and the bonding plate 220, 340, but the two are not concentric. Alignment between the work coil 410 and a bonding plate 220, 340 ensures even and efficient heating of the bonding plate 220, 340, which results in high integrity bonds between the roofing membrane and the bonding plate 220, 340. Alignment also prevents excess heating of metallic materials surrounding the bonding plate 220, 340, such as a foil facing on rigid foam insulation beneath the bonding plate 220, 340.

A bonding plate 340 (See FIG. 14, reference numeral 220, and schematically represented, reference numeral 340 in FIGS. 20 and 21) has a raised top surface coated with heat activated adhesive 230. The bonding plate 340 produces a raised "bump" in roofing membrane that can be used to help locate the work coil 410 over the bonding plate 340. The wall 334 or wall segments defining the recess 330 do not extend across the front end of the base 303, leaving an opening 336 at the front of the base 303. This opening 336 allows the operator to place the tool 300 generally over the raised portion of membrane over a bonding plate 340, and advance the tool 300 forward until the raised portion contacts the wall 334 at the rear of the recess 330, which provides tactile feedback to the operator that the bonding plate 340 is now in position beneath the work coil 410, as shown in FIG. 20.

The tool 300 incorporates a temperature sensor 460 positioned in the base 303, near bottom surface of the base 303. The temperature sensor 460 is positioned to sense the temperature of the roof surface and provide a temperature signal 462 to the joule controller circuit 470, as shown in FIG. 21. The temperature sensor 460 is spaced apart from the work coil 410, which gets hot during use of the tool 300. The temperature signal 462 is employed by the joule controller circuit 470 to adjust energy delivered to a plate 340 magnetically coupled to the work coil 410 during an induction heating cycle. A higher temperature at the roof membrane (and plate 340) generally means less energy is needed to bring the temperature of the plate 340 to a temperature that will activate (melt) the heat activated adhesive.

The tool 300 also incorporates a potentiometer 316 connected to a knob 319 mounted to the forward end of the housing 301, 302. The potentiometer 316 allows the user to adjust the energy delivered to a plate as conditions on the job site may require. For example, a cold wet day may require additional energy delivered to each plate to melt the adhesive and form a good bond with the roof membrane. The operator can perform one or more test welds under field conditions and examine the resulting bonds. The potentiometer 316 produces an energy adjustment signal 464 that is provided to the joule controller circuit 470, as shown in FIG. 21. The potentiometer 316 has a center point indicated by corresponding marks on the knob 319 and housing 301, 302. The potentiometer center point represents a neutral position where the adjustment does not increase or decrease energy delivered to the plate 340. Rotation of the knob 319 and potentiometer 316 in a first direction (clockwise) increases energy delivered to the plate 340 by approximately 15% to 20%, while rotation of the knob 319 and potentiometer 316 in a second direction reduce energy delivered to the plate 340 by approximately 15% to 20%. This easy to understand adjustment allows operators to "tune" performance of the tool 300 to field conditions and make adjustments over the course of a day as conditions change. The temperature signal 462 and energy adjustment signal 464 may be used independently by the joule control circuit 470 to alter the pattern and/or duration of energy delivery to a bonding plate 340. Alternatively, the temperature signal 462 and energy adjustment signal 464 may be combined and the combined value employed to alter the pattern and/or duration of energy delivery to a bonding plate 340.

The power inverter circuit 450 is configured to generate a power consumed signal 452, the magnitude of which corresponds to power consumed by the work coil 410 during an induction heating cycle. The power consumed signal 452 is delivered to the joule controller circuit 470 and is used to define the quantity of energy generated by the power inverter circuit 450 during each induction heating cycle. The joule controller circuit 470 generates an enable inverter signal 472 that initiates each induction heating cycle by the power inverter circuit 450 and the enable inverter signal 472 must be present for the power inverter circuit 450 to operate. The power consumed signal 452 must have a positive value indicating that a plate 340 is at least partially magnetically coupled to the work coil 410. If the power consumed signal 452 is below a threshold value, the induction heating cycle is terminated.

The power inverter circuit 450 and joule controller circuit 470 are initially configured to deliver a pre-determined quantity of energy to a bonding plate at a pre-determined distance from the work coil over a pre-determined time. In one embodiment, the quantity of energy is approximately 4000 joules, the distance is approximately 0.180 inches and the time is about 5 seconds. From this starting point, the temperature signal 462 and the energy adjustment signal 464 are used by the joule controller circuit 470 to increase or decrease the quantity of energy delivered to a bonding plate 340 coupled to the magnetic field generated by the work coil 410. In one embodiment of a joule controller circuit 470 partially illustrated in FIG. 22, the power consumed signal 452 is used to generate a variable input 454 to a transistor T1 that controls discharge of a capacitor C1. The power consumed signal 452 may be a voltage and operational amplifier 474 may be configured as a voltage to current converter. The variable current 454 is used to control current flow through transistor T1, which determines the rate at which capacitor C1 discharges to ground. The voltage across the capacitor C1 decreases as it discharges. The voltage across capacitor C1 is one input to a comparator 476. The other input to the comparator 476 is a value derived from the temperature signal 462 and energy adjustment signal 464. When the voltage across capacitor C1 falls below the value at the other input of comparator 476, then the enable inverter signal 472 is cut off, turning off the power inverter circuit 450, ending an induction heating cycle.

According to aspects of the disclosure, the energy consumed signal 452 is only present when a plate 340 is inductively coupled to the work coil 410. The energy consumed signal 452 is evaluated to determine if the value indicates a plate is coupled to the work coil 410. Evaluation of the energy consumed signal 452 may be conducted by sending the energy consumed signal to a comparator for comparison to a pre-determined standard. If the energy consumed signal 452 is greater than the pre-determined standard, then activation of the power inverter circuit 450 is enabled. If the energy consumed signal 452 is less than the pre-determined standard, then activation of the power inverter circuit 450 is disabled and the heating cycle is terminated. The energy consumed signal 452 is used for two purposes: as one of a plurality of inputs to the joule controller 470 that are used to determine the length of time that the power inverter circuit 450 applies energy to the work coil 410; and as a no load inhibitor when a plate is not present or is grossly misaligned relative to the work coil 410. This prevents activation of a heating cycle in circumstances that may overheat a foil facing on the rigid foam insulation beneath the roof membrane.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed:

1. A portable induction heating tool comprising:

a housing including a base having a front end, a rear end, and an exterior support surface on which the portable induction heating tool rests, said exterior support surface defining a recess facing away from said housing, said recess at least partially defined by a wall projecting from said exterior support surface, said recess being open toward the front end of the base, and said wall defining a rear limit of said recess, said rear limit located between the front end and the rear end of said base;

a work coil within said housing and secured adjacent to an interior surface of said base in a location aligned with said recess;

electronic circuitry including a power inverter connected to apply oscillating electrical energy to said work coil, thereby generating an oscillating magnetic field projecting away from said base, said power inverter generating a power consumed signal corresponding to power consumed by the work coil when the work coil is generating said oscillating magnetic field and the work coil is inductively coupled to a workpiece, said power consumed signal used as a variable input to a joule controller to define a quantity of energy generated by the power inverter to limit said quantity of energy to a predetermined quantity during an induction heating cycle.

2. The portable induction heating tool of claim 1, wherein said base has a front end and a rear end, and said recess is located at the front end of the base.

3. The portable induction heating tool of claim 1, wherein said base has a front end and a rear end, and said recess is located at the front end of the base, said wall defining a rear end of said recess, said rear end located between the front end and rear end of the base.

4. The portable induction heating tool of claim 1, wherein said tool comprises a temperature sensor arranged to detect a temperature adjacent said exterior support surface and provide a temperature signal to said joule controller, said joule controller using said temperature signal in combination with said variable input to adjust said predetermined quantity.

5. The portable induction heating tool of claim 1, wherein said tool comprises an energy delivery adjustment connected to said electronic circuitry, said energy delivery adjustment located on an exterior of said housing, said energy delivery adjustment generating an adjustment signal to said joule controller to increase or decrease said predetermined quantity.

6. The portable induction heating tool of claim 1, wherein said tool comprises a temperature sensor arranged to detect a temperature adjacent said exterior support surface and provide a temperature signal to said joule controller; and an energy delivery adjustment connected to said joule controller, said energy delivery adjustment located on an exterior of said housing, said energy delivery adjustment generating an adjustment signal to said joule controller, wherein said joule controller employs both said temperature signal and said adjustment signal to adjust said predetermined quantity.

7. The portable induction heating tool of claim 1, wherein a value of said power consumed signal is greatest when the workpiece is aligned with said work coil, and said joule controller terminates the application of oscillating electrical energy to said work coil if said power consumed signal is less than a pre-determined value.

* * * * *